US012442269B2

(12) United States Patent
Campbell

(10) Patent No.: US 12,442,269 B2
(45) Date of Patent: Oct. 14, 2025

(54) PACKERLESS FRACKING TOOL, SYSTEM, PIPING ASSEMBLY AND METHOD USING CONTINUOUS TUBING FOR OPENING INFINITE STAGES OF SLIDING SLEEVES

(71) Applicant: Progressive Tool Design Inc., Airdrie (CA)

(72) Inventor: Sean P. Campbell, Airdrie (CA)

(73) Assignee: Progressive Tool Design Inc., Airdrie (CA)

( * ) Notice: Subject to any disclaimer, the term of this patent is extended or adjusted under 35 U.S.C. 154(b) by 0 days.

(21) Appl. No.: 18/434,167

(22) Filed: Feb. 6, 2024

(65) Prior Publication Data

US 2025/0237116 A1 Jul. 24, 2025

Related U.S. Application Data

(63) Continuation of application No. PCT/CA2024/050058, filed on Jan. 18, 2024.

(51) Int. Cl.
*E21B 34/14* (2006.01)
*E21B 33/12* (2006.01)
*E21B 43/26* (2006.01)

(52) U.S. Cl.
CPC ..... *E21B 33/1208* (2013.01); *E21B 34/14* (2013.01); *E21B 43/26* (2013.01); *E21B 2200/06* (2020.05)

(58) Field of Classification Search
CPC ..... E21B 33/1208; E21B 34/14; E21B 43/26; E21B 2200/06
See application file for complete search history.

(56) References Cited

U.S. PATENT DOCUMENTS 3,166,128 A 1/1965 Myers
3,355,142 A * 11/1967 Castro ..... E21B 34/14 137/515

(Continued)

FOREIGN PATENT DOCUMENTS

CA 2934046 A1 6/2015

OTHER PUBLICATIONS

International Search Report mailed Oct. 11, 2024 in corresponding International Patent Application No. PCT/CA2024/050058.

*Primary Examiner* — Steven A MacDonald
(74) *Attorney, Agent, or Firm* — Harness, Dickey & Pierce, P.L.C.

(57) ABSTRACT

A tool, a piping assembly, a system using the tool and piping assembly, and a method using such tool and piping assembly for fracking and production of hydrocarbons from an underground hydrocarbon formation is disclosed. The tool is conveyed downhole using continuous tubing, and by application of fluid pressure supplied to the tool configured in three distinct configurations—a first non-actuated configuration, a second actuated configuration, and a third emergency release/flushing configuration. The emergency release/flushing configuration may be actuated to initiate flushing of pressurized fluid in the region of the tool to flush sand and detritus and thereby prevent or overcome sanding-in or lodging of the tool within the wellbore. The tool, when used with the piping assembly as disclosed, reduces fracking times by allowing continuous deployment of the tool without having to activate and deactivate the tool at each fracking stage.

12 Claims, 14 Drawing Sheets

(56) References Cited

U.S. PATENT DOCUMENTS

| | | | | |
|---|---|---|---|---|
| 3,856,081 | A * | 12/1974 | Canalizo | E21B 33/129 166/123 |
| 6,551,030 | B1 * | 4/2003 | Curry | E02B 17/0008 403/321 |
| 7,210,534 | B2 * | 5/2007 | Hayter | E21B 34/102 166/334.1 |
| 7,325,617 | B2 * | 2/2008 | Murray | E21B 34/14 166/376 |
| 7,398,832 | B2 | 7/2008 | Brisco | |
| 7,926,580 | B1 | 4/2011 | Darnell et al. | |
| 8,235,114 | B2 | 8/2012 | Clem et al. | |
| 8,522,877 | B2 * | 9/2013 | Chambers | E21B 34/14 166/334.1 |
| 8,893,810 | B2 | 11/2014 | Zimmerman et al. | |
| 10,087,734 | B2 | 10/2018 | Fehr et al. | |
| 2004/0222022 | A1 * | 11/2004 | Nevlud | E21B 10/322 166/266 |
| 2009/0056934 | A1 * | 3/2009 | Xu | E21B 43/26 166/194 |
| 2011/0042107 | A1 * | 2/2011 | Chambers | E21B 34/14 166/334.1 |
| 2011/0226489 | A1 | 9/2011 | Hofman et al. | |
| 2014/0174746 | A1 | 6/2014 | George et al. | |
| 2017/0058644 | A1 | 3/2017 | Andreychuk et al. | |
| 2017/0314364 | A1 | 11/2017 | Getzlaf et al. | |
| 2018/0371858 | A1 | 12/2018 | Davis et al. | |

* cited by examiner

PACKERLESS FRACKING TOOL, SYSTEM, PIPING ASSEMBLY AND METHOD USING CONTINUOUS TUBING FOR OPENING INFINITE STAGES OF SLIDING SLEEVES

CROSS-REFERENCE TO RELATED APPLICATIONS

This application is a continuation of PCT International Application No. PCT/CA/2024/050058 filed Jan. 18, 2024 and also claims priority of Canadian Patent Application No. 3,226,382 filed Jan. 18, 2024. The entire disclosures of each of the above applications are incorporated herein by reference.

FIELD

The present invention relates to fracking apparatus and methods, and more particularly to a fracking tool, system, piping assembly and method using continuous tubing for opening sliding sleeves within a wellbore to carry out fracking and completion of the wellbore for subsequent production therefrom.

BACKGROUND

During completion of underground wells for subsequent production of hydrocarbons therefrom it is typically necessary, after drilling of a wellbore and the insertion of production piping therein, to inject pressurized fluid down the wellbore and into the underground formation via ports along such wellbore in a region where hydrocarbons are known to be present, so as to thereby hydraulically fracture rock in such region so as to better permit hydrocarbons to flow to the wellbore and into the wellbore via such fissures so as to then be pumped via the piping to surface. This completion procedure is known as fracking.

Many prior art downhole fracking tools exist that are used for opening sliding sleeves covering ports along piping in wellbores. Certain of these prior art tools, while possessing sophisticated designs, often possessed a plurality of complex components which are often difficult and expensive to machine. Moreover, the presence of a plethora of moving parts creates potential for such tools, particularly in the harsh operating environments to which such tools are exposed, to be prone to abrasive wear. Consequent failure of just one of such components due to various factors such as sand and detritus, including abrasive proppants used in such fracking fluids, can easily lead to early failure of the tool.

Moreover, the complexity of certain of the prior art fracking tool designs adds to the cost of manufacture and often the length and weight of such tools, thereby adding to the cost to handle such tool and in the steel needed to make such tool.

Still further, prior art designs often incorporate expandable packing elements on both an uphole and a downhole side of an actuating tool, to allow the tool to effectively seal the piping in a region around an opened sleeve and to permit injection of fracking fluid directly into an opened port. Disadvantageously, in operation, such prior art tools often require a number of time-consuming steps, namely requiring the tool to firstly be lowered and then raised to firstly open the sliding sleeve at an associated port, the tool then again lowered to the region of the opened port, the packers thereon then required to be actuated to seal the wellbore in the region of the opened port, the fracking operation then completed by injection of fluid through the tool and into the formation, and the packers then needed to be deactuated before the tool can then be further moved uphole to actuate and open another more uphole sliding sleeve and carrying out an additional fracking operation. Such plethora of steps greatly increases the time to frack a wellbore, and particularly a wellbore with a large number of ports therein.

Lastly, and by way of a particularly vexing problem, the complexity of the certain prior art designs requires many components within a restricted space often, due to consequent undesirable flow restriction within the tool supplying such pressurized fluid, thereby reduces the available pressure of fluid which ultimately is being supplied to the port in the wellbore for injection into the formation. Such adversely affects the extent to which surrounding rock may be fracked without increasing the pressure and thus the thickness and robustness of the components and the fluid pumping equipment. This frequently creates a vicious circle where due to increased pressures, components need to be made larger and more robust, thereby exacerbating the problem of obtaining increased pressure at the opened ports for supplying pressurized fluid to a desired location along a wellbore.

CA 2,934,046 entitled "Autonomous Selective Shifting Tool" applied for by Weatherford/Lamb, Inc. and published Jun. 25, 2015 teaches a fracturing system for selectively opening various ports in a tubular housing, having a tubular housing with ports therein and a bore therethrough and a slidable sleeve disposed in the housing and longitudinally moveable within the bore between a closed position covering ports in the housing and an open position uncovering the ports. One or more locator tags, such as an RFID tag (radio frequency identification), are embedded in the housing. Sensing by a tool of an RFID tag by a lowered tool, should such RFID tag match the desired sliding sleeve which the tool is to actuate, allows the tool to actuate the particular desired sleeve.

U.S. Pat. No. 7,926,580 to Darnell et al. teaches a coiled tubing multi-zone frac system for fracking a formation adjacent a well using a sliding sleeve and erodible jets. Erodible jets may provide a means for perforating, fracking and flowing the well which takes the place of two separate tools that are otherwise needed to cause a well to flow.

U.S. Pat. No. 8,235,114 to Clem et al. teaches a fracturing and gravel packing tool having features that prevent well swabbing when the tool is picked up with respect to a set isolation packer. An upper or jet valve allows switching between the squeeze and circulation positions without risk of closing the wash pipe valve. The wash pipe valve can only be closed with multiple movements in opposed direction that occur after a predetermined force is held for a finite time to allow movement that arms the wash pipe valve. The jet valve can prevent fluid loss to the formation when being set down whether the crossover tool is supported on the packer or on the smart collet.

U.S. Pat. No. 8,893,810 to Zimmerman et al. teaches the use of a plurality of sliding sleeves deployed on tubing in a wellbore annulus for wellbore fluid treatment. Operators deploy a plug down the tubing to a first sleeve. The plug seats in this first sleeve, and pumped fluid pressure opens the first sleeve and communicates from the tubing to the wellbore annulus. In the annulus, the fluid pressure creates a pressure differential between the wellbore annulus pressure and a pressure chamber on second sleeves on the tubing. The resulting pressure differential opens the second sleeves so that fluid pressure from the tubing can communicate through the second open sleeves. Using this arrangement, one sleeve can be opened in a cluster of sleeves without opening all of them at the same time. The deployed plug is only required to open the fluid pressure to the annulus by opening the first sleeve. The pressure chambers actuate the second sleeves to open up the tubing to the annulus.

U.S. Pat. No. 10,087,734 to Fehr et al. teaches a method for fracturing a formation which includes positioning a fluid treatment string in the formation. The fluid treatment string includes a port configured to pass fracturing fluid from within the string's inner bore to outside the string, and a sliding sleeve located inside string and configured to move by fluid pressure within the inner bore of the fluid treatment string between (i) a first position in which the sliding sleeve covers the port and (ii) a second position in which the sliding sleeve exposes the port to the inner bore. The method also includes applying a fluid pressure within the inner bore such that the sliding sleeve moves from the first position to the second position without the sliding sleeve engaging a sealing device, and pumping fracturing fluid through the inner bore and through the port to fracture a portion of the formation.

US Patent Publication No. 2017/0058644 to Andreychuk et al. teaches a bottom hole actuator tool for locating and actuating one or more sleeve valves spaced along a completion string. A shifting tool includes radially extending dogs at ends of radially controllable, and circumferentially spaced support arms. Conveyance tubing actuated shifting of an activation mandrel, indexed by a J-Slot, cams the arms radially inward to overcome the biasing for in and out of hole movement, and for releasing the arms for sleeve locating and sleeve profile engagement. A cone, movable with the mandrel engages the dogs for positive locking of the dogs in the profile for sleeve opening and closing. A treatment isolation packer can be actuated with cone engagement. The positive engagement and compact axial components results in short sleeve valves.

U.S. Pat. No. 7,398,832 to Brisco teaches an apparatus and method for forming a monodiameter wellbore casing. The casing includes a second casing positioned in an overlapping relation to a first casing. The inside diameter of the overlapping portion and at least a portion of the second casing are substantially equal to the inside diameter of the non-overlapping portion of the first casing. The apparatus includes a support member, an adaptor coupled to the support member, an outer sleeve coupled to the adaptor, a hydraulic slip body coupled to the outer sleeve, a packer cup mandrel coupled to the hydraulic slip body, hydraulic slips coupled to the hydraulic slip body, a shoe coupled to the outer sleeve, an inner mandrel coupled to the shoe and hydraulic slip body, an expansion cone mandrel coupled to the inner mandrel, an expansion cone coupled to the expansion cone mandrel, and a guide nose coupled to the expansion cone mandrel.

The aforesaid prior-art downhole fracking tools, however, still one or more of the aforementioned disadvantages. For example, some prior-art downhole fracking tools such as those using J-slots generally require a plurality of steps and consequently a long time to complete a fracking process. For example, in some prior-art downhole fracking tools, a J-slot having up to six positions is used, and the downhole fracking tool needs to cycle through the six positions to complete the fracking process which significantly increases the fracking time.

Accordingly, and despite the above prior art designs, new tool and fracking systems are always needed, and importantly and specifically, tools, systems, and methods which are designed so as to require significantly less time (and thus expense) to rapidly allow fracking of an entire wellbore.

New fracking tools and systems are further always needed that are simple in their design, smaller in size and weight and less costly to manufacture, and which are further mechanically reliable.

New fracking tools and systems are further always needed that are less prone to become lodged in a wellbore. New fracking tools, systems, and methods are needed which have features and a configuration to assist in eliminating such serious problem.

SUMMARY

This section provides a general summary of the disclosure, and is not a comprehensive disclosure of its full scope or all of its features.

Reference herein to the "downhole" side or end of a component shall be understood as referencing, in relation to such component when situated in a wellbore, a side or end thereof farthest the point of entry of the wellbore into the ground, and specifically the side or end of such component when in such orientation which is farthest from the point of entry of the wellbore i.e. the side or end of such component when in such orientation that is closest the most distal end of the wellbore.

Reference herein to a direction "downhole" shall mean the direction, in relation to a component, towards the distal end of a wellbore.

Reference herein to the "uphole" side or end of a component shall be understood as referencing in relation to such component when situated in a wellbore, a side or end thereof closes the point of entry of the wellbore into the ground, and specifically the side or end of such component when in such orientation which is closest to the point of entry of the wellbore i.e. the side or end of such component when in such orientation that is farthest from the most distal end of the wellbore.

Reference herein to "uphole" of a component or a direction "uphole" shall mean the direction along the wellbore towards the point of entry of the wellbore into the ground.

Reference to top or bottom of a tool shall be understood as meaning, as regards the top of a tool the portion of the tool that when in a wellbore is most proximate the uphole end of the wellbore, and as regards the bottom of a tool the portion of the tool that when in a wellbore is most proximate the distal end of the wellbore.

The present invention has, as one of its objects as regards certain of its embodiments, the objective of providing a mechanically simple design in comparison to certain prior art tools, which is both relatively inexpensive and simple to manufacture.

The present invention has as another object, as regards certain other embodiments, the objective of providing a system and tool design that saves time and steps necessary in completing fracking operations in a wellbore.

The present invention has as one of its objects as regards certain other or similar embodiments of the system and tool of the present invention the object of providing a mechanically simple design in comparison to certain prior art tools which has the ability to be able to flush components thereof to avoid buildup of abrasive materials and thereby increase the duration of life of tool.

The present tool and system has, in another one of its further objects, the object of providing a tool, system and method for operating such tool that provides a feature for assisting in flushing debris and sand and thus means for dislodging the tool from within the wellbore in the event that the tool should become lodged in the wellbore or as a preventative measure.

Accordingly, in a first broad embodiment of the present invention, the present invention comprises a sleeve-actuating tool for use in opening or closing sleeves that are situated along piping within a wellbore, where the tool is adapted to be coupled to a distal end of continuous tubing and conveyed downhole in a wellbore.

In such first broad embodiment the sleeve-actuating tool itself comprises:

(i) an elongate hollow mandrel, having an outer periphery and a longitudinal bore and coupleable at an uphole end thereof to a distal end of continuous tubing and adapted to be in fluid communication with said continuous tubing;

(ii) an elongate piston member, having a longitudinal bore and itself situated in said longitudinal bore of the mandrel proximate an uphole end thereof and axially slidable within the longitudinal bore of the mandrel;

(iii) a corresponding plurality of longitudinally-extending, circumferentially-spaced collets, each having a camming surface on an elongate interior surface thereof and each having a radially-outwardly extending protuberance on an outer periphery thereof which, when actuated, resiliently extend radially outwardly from the outer periphery of the mandrel;

(iv) an elongate camming member, having a longitudinal bore and one or more cams on an exterior periphery thereof adapted for physical contact with said camming surface on the interior elongate surface on each of the collets, the camming member coupled to the piston member and axially slidable within said longitudinal bore of the mandrel;

(v) a spring member, biasing the elongate camming member and the piston member in an uphole direction along the longitudinal bore of the mandrel to a first axial position within the tool such that the elongate camming member and the cams thereon allow the protuberances on the collets to each thereby be positioned in a radially-retracted position within the outer periphery of the mandrel;

wherein upon fluid under a first pressure being provided in the continuous tubing to an uphole end of the tool, the piston member of the tool is forced downhole and is adapted, when forced downhole, to: (a) force the elongate camming member to a second axial position more downhole than the first axial position thereby compressing or further compressing said spring member, and (b) cause the cams thereon to likewise move longitudinally downhole and engage the camming surface on each of the longitudinally-extending collets thereby causing the protuberances thereon to extend radially outwardly past the outer periphery of the mandrel.

In a further refinement of the above sleeve-actuating tool the one or more cams comprise at least one wedge member and are adapted to contact corresponding one or more correspondingly-configured wedge members on the camming surface on each of the collets.

In yet a further preferred refinement of the above sleeve-actuating tool, the longitudinal bore of the piston member and the longitudinal bore of the camming member are co-axial and longitudinally aligned such that fluid may pass therethrough.

In yet a further preferred refinement of the above sleeve-actuating tool, such tool further comprises at least one radial port in said mandrel proximate an uphole end of thereof which is adapted to permit, when opened, flow of fluid from the longitudinal bore of the mandrel to an exterior of the mandrel.

In yet a further preferred refinement of the above sleeve-actuating tool the piston member is slidably moveable within the mandrel from:

(i) a first most-uphole position where the protuberances are caused to be radially retracted and the tool is in a run-in position; to (ii) a second intermediate position more downhole than the first most-uphole position, namely wherein the piston member nevertheless still covers each of said at least one radial ports and wherein the protuberances are in a radially-outwardly extended position and the tool is thus configured to be in an actuated position; to (iii) a third axially most-downhole position, wherein the piston member has uncovered or at least partly uncovered the at least one radial port in the mandrel so as to permit fluid under pressure to pass from within the longitudinal bore of the mandrel to an exterior periphery of the mandrel.

In yet a further preferred refinement of the above sleeve-actuating tool, the piston member further comprises a plug seat at a most-uphole end thereof, the plug seat adapted to receive therein a plug member flowed downhole in said continuous tubing, wherein the plug seat when the plug member is seated therein prevents flow of pressurized fluid through the piston member and causes the piston member to move to the third most-downhole position.

In yet a further preferred refinement of the above sleeve-actuating tool, such tool further possesses a frangible release member releasably securing the spring member at one end thereof, wherein upon the plug member being flowed downhole in said continuous tubing and onto said plug seat and fluid under a second pressure being provided to the tool via the continuous tubing, the piston member is configured so as to be forced downhole so as to cause the frangible release member to shear, so as to:

(i) release the one end of the spring member from releasable securement; and (ii) thereby permit the piston member and elongate camming member to move downhole or further downhole in the tool to the third axially most-downhole position.

In yet a further preferred refinement of the above sleeve-actuating tool the frangible release member (which in a preferred embodiment may comprise one or more shear screws) releasably secures one end of the spring member in a fixed axial position within the longitudinal bore of the mandrel, and the piston member when forced downhole to the third axially most-downhole position causes to the frangible release member to be sheared thereby releasing said one end of the spring member from releasable securement and thereby permitting the piston member and elongate camming member to move further downhole so as to:

(i) cause the cams on the elongate camming member to permit the protuberances on the collets to return to a radially-retracted position within the outer periphery of the mandrel; and (ii) uncover, or uncover some of, the at least one radial ports, so as to permit fluid under pressure to pass from within the longitudinal bore of the mandrel to an exterior of the mandrel.

In a second broad aspect of the present invention the present invention comprises a system for slidably opening sleeves that are covering ports situated along a wellbore, the system comprising:

(I) a tool, such tool comprising:

an elongate, hollow mandrel having a longitudinal bore therein, configured so as to be coupleable at an uphole end thereof to a distal end of a continuous tubing and in fluid communication with the continuous tubing;

an elongate piston member having a longitudinal bore and which is itself situated in said longitudinal bore of the hollow mandrel proximate an uphole end thereof, said piston member axially slidable within the longitudinal bore of the mandrel;

a plurality of longitudinally-extending, circumferentially-spaced collets, each having a camming surface on an elongate interior surface thereof and each having a radially-outwardly extending protuberance on an outer periphery thereof which protuberance, when actuated, resiliently extends radially outwardly from an outer periphery of the mandrel;

an elongate camming member having a longitudinal bore and one or more cams on an exterior periphery thereof adapted for physical contact with said camming surface on the elongate interior surface on each of the collets, the elongate camming member coupled to the piston member and axially slidable within said longitudinal bore of the mandrel;

a spring member, biasing the elongate camming member and the piston member in an uphole direction along the longitudinal bore of the mandrel such that the cams on the elongate camming member cause the protuberances on the collets to each be in a radially-retracted position;

wherein the piston member is slidably moveable within the mandrel from:

(i) a first most-uphole position where the protuberances are caused to be in the radially retracted position and the tool is in a run-in position; to (ii) a second position more downhole than the first most-uphole position, namely a position wherein the protuberances are caused by the piston member to be in a radially-outwardly extended position when the tool is thusly configured to be in an actuated state;

(II) piping within the wellbore having a plurality of slidable sleeves that are positioned along the piping and cover a respective corresponding plurality of ports situated along the piping;

(i) each of the slidable sleeves releasably retained in a downhole position within the piping and covering a respective of the plurality of ports by engagement of one or more radially outwardly-biased tabbed finger members on the slidable sleeves with a first annular groove situated on an interior periphery of said piping;

wherein the tool when caused to be configured in the actuated state and the protuberances on the tool engage the tabbed finger members on the slidable sleeve and the tool is moved uphole, the tabbed finger members a disengage the first annular groove and both they and the sliding sleeve are adapted to then together be moved uphole to an uphole position uncovering the respective port in said piping, where the tabbed finger members thereof then engage a second deeper recessed annular groove more uphole in said piping, which second deeper annular groove when engaged by the tabbed finger members permits the tabbed finger members to become disengaged with the protuberances on the tool and thereby allows the tool to be further pulled uphole to similarly engage and slidably open a further more-uphole sliding sleeve.

In a further refinement of this system (second broad aspect of the invention), such system may further comprise:

at least one radial port in the mandrel proximate an uphole end of thereof which is adapted to permit, when opened, flow of fluid from the longitudinal bore of the mandrel to an exterior of the mandrel; and the tool is further configured so as to permit, upon a plug member being flowed down the continuous piping to the tool, the piston member to be moved further downhole to a third axially most-downhole position, wherein said piston member thereby uncovers or at least partly uncovers the at least one radial port in said mandrel so as to permit fluid under pressure to pass from within said longitudinal bore of said mandrel to an exterior of said mandrel and wherein said elongate camming member has been further moved downhole to a position wherein cams thereon permit the protuberances on the collets to return to the radially-retracted run-in position within the outer periphery of the mandrel.

In a third broad aspect of the present invention, the present invention comprises a method for slidably opening sleeves that are respectively covering a corresponding plurality of ports longitudinally spaced and situated along piping in a wellbore, comprising the steps of:

affixing a tool to a distal end of continuous tubing such that the tool is in fluid communication therewith;

running the continuous tubing and affixed tool downhole through a plurality of slidable sleeves respectively covering said plurality of ports, so as to position the tool proximate a distal end of the wellbore;

applying a first fluid pressure within said continuous tubing and causing a piston member and elongate camming member coupled together in said tool to be moved axially downhole in said tool so as to cause cams on said elongate camming member to contact an interior camming surface on each of a plurality of collets circumferentially spaced about a periphery of the tool, so as to cause radial outward extension of protuberances on each of said collets past an outer periphery of the tool;

pulling upwardly on the continuous tubing and affixed tool so as to cause the radially-extended protuberances on the tool to engage the at least one sliding sleeve in the region of outwardly-biased tabbed finger members thereon and sliding the at least one sliding sleeve uphole so as to thereby uncover and thereby open the respective one of the at least one ports along the piping;

retaining the sliding sleeve in such opened position by each outwardly-biased tabbed finger members on the sliding sleeve then becoming releasably engaged with an annular interior groove in the piping, thereby simultaneously releasing the protuberances on the collets from engagement with said tabbed finger members on the sliding sleeves and permitting the tool to be further pulled uphole without radial retraction of said protuberances.

In a further refinement of the above method, in the event the tool and continuous tubing should become lodged in said piping where further uphole movement of the tool and continuous tubing is prevented or for any other reason, the method further comprises flowing a plug member down the continuous tubing and into the bore of the tool thereby obstructing the longitudinal bore of the piston member and preventing fluid under pressure flowing through piston member of the tool and thusly applying fluid pressure to an uphole end of the piston so as to cause further downhole displacement of the piston member so as to:

(i) uncover a radial port within said tool to thereby cause fluid under pressure within the longitudinal bore of the tool to then travel via said radial port to an exterior of the tool and into an annular region between the tool and the piping so as to flush sand or detritus around the tool out into the formation via the plurality of associated opened ports in the d piping thereby potentially dislodging the tool and continuous tubing from within the piping.

In yet a further refinement of the method of the present invention for slidably opening sleeves, such method may further comprising, at the time of carrying out step (i) above:

(ii) causing the elongate camming member and the cams thereon to further interact with the interior camming surface on each of the collets in a manner that allows radial inward retraction of the protrusions on the tool to an extent that the protrusions no longer extend radially outwardly from the exterior of the tool.

Advantageously, as may now be understood and as shall now be apparent to a person of skill in the art from the above summary of various embodiments of the invention, the present invention teaches a tool, system, and method that allows selectively configuring the tool, when desired, to not only be in either a "run-in" position for running past valves and their associated sliding sleeves within a wellbore which may be in a desired open or closed position, but when reaching a valve or series of valves that are desired to be changed from their existing closed (or open) position to instead an open (or closed position), allows the tool to transform to then be in an "actuated" position by a mere application of fluid pressure to the tool. Thus fluid pressure which is supplied to the continuous tubing and thereafter to the tool itself from uphole allows the tool to reconfigure itself so as to then be able to engage a desired sliding sleeve of the one or more sliding sleeves and thereby move it to the desired open (or closed) position.

Further advantageously, as may now be understood and be apparent to a person of skill in the art from the above summary of various embodiments of the invention, in particular the system of the present invention, the seal barrier to the underground hydrocarbon formation desired to be fracked and produced will be the sliding sleeves valves themselves located along the piping covering the associated ports (hereinafter sometimes collectively referred to as "valves"). There is thus no requirement or need for a barrier in the inner diameter of the piping in the wellbore in the event the formation being produced is under high pressure and/or contains toxic gases.

The tool of the present invention when being positioned downhole by the continuous tubing may be actuated to extend the radially extendable protuberances thereon to engage each desired sliding sleeve to thereby move any such slidable sleeves to a closed position to ensure all sliding sleeves are closed prior to commencing fracking.

The tool conversely, when pulled uphole, can be used to engage and open one or more desired closed sleeves as the tool is being pulled uphole to thereby open them, for the purposes of allowing fracking and thereafter production from the wellbore.

Fracturing of the formation can thus be done through multiple selected open valves or a single open valve, and in any order, with the use of fluid pressure supplied to the continuous tubing to thereby activate the tool hydraulically and allow it to then engage and thereafter move, by pulling up or lowering the tool via the continuous tubing to which it is attached, a selected sliding sleeve or group of sliding sleeves to a desired open or closed position.

Still further advantageously, downhole tools can often become lodged within a the piping of wellbore due to inflow of sand into a wellbore as frequently often happens due to inflow of sand or detritus from the formation via one or more opened ports, or upon continual buildup of sand on an uphole side of a tool when being pulled uphole, thereby causing the tool to become lodged and thereafter being incapable of being withdrawn uphole. This is a serious potential problem which puts the entire viability of a well in jeopardy.

As noted above the tool of the present invention not only provides the above features and capabilities, but in a further refinement further provides a means to assist in further dislodging the tool from within the piping, should the tool become lodged during its operation within the wellbore (namely a so-called "emergency release" configuration), to allow the tool to become dislodged.

Specifically, as noted above, the tool in such embodiment a plug seat is further provided on the moveable piston, and shear screws may be provided at one end of the spring member. Should such embodiment of the tool become lodged within the wellbore, a plug member may be flowed down the continuous tubing to thereafter then sit in the provided plug seat. Thereafter application of fluid pressure to the continuous tubing causes the piston member to thereby, due to its longitudinal bore now being plugged by the plug member seated in the plug seat) provide a higher force to the piston member, causing the shear screws to shear thereby freeing an otherwise fixed end of the spring member, and permitting the piston member and elongate camming member to move further downhole, thereby not only retracting the extended protuberances, but importantly causing high pressure fluid to flow from the longitudinal bore of the tool out of the tool via the one or more radial ports thereon thereby providing a manner by which high pressure fluid may then be supplied around the outer periphery of the tool, particularly on the uphole side of the tool where sand and detritus typically concentrates when the tool is being pulled uphole, in order to effectively flushing such sand and/or detritus from such uphole region of the tool thereby usually effectively dislodging such tool from within the piping and thereafter allowing free uphole and downhole movement of the tool within the piping.

Still further advantageously, in a preferred embodiment, the system of the present invention and the tool is configured and provided with features that allows the tool to be pulled uphole quickly to simultaneously actuate a group ("cluster") of valves without having to cyclically apply and immediately remove fluid pressure being applied to the continuous tubing to firstly radially extend and then after opening of the sliding sleeve, radially retract the protuberances, so as to then be able to move the tool further uphole and past the opened sleeve, and which system further provides means for retaining the sleeve in both the closed and the open position.

Specifically and advantageously, in an embodiment of the invention as disclosed above, the system of the present invention may provide radially-outwardly extending tabbed finger members that engage a first annular recess in the piping in the region of the valve when the valve is in the closed position, and engage a second deeper uphole annular recess when the associated sliding sleeve is then moved to the uphole (opened) position. By having a deeper second annular grove, the tabbed finger members which the tool initially engages will when the sliding sleeve I moved to the open uphole position, then be permitted to extend more radially outwardly into the deeper annular groove, thereby removing the tabbed finger members from engagement with the tool and thereby allowing the tool and associated continuous tubing to be further pulled uphole, to open additional uphole sliding sleeves (valves) or to be removed from the wellbore.

Lastly, as alluded to above, the present invention includes specially-adapted piping assembly especially suited for use in wellbores where fracking of such wellbores may be carried out using a tool of the present invention.

In this regard, the present invention includes a specially configured piping sub assembly for use in wellbores and for fracking and production in such wellbores, where ports in the piping sub are used. In a broad embodiment, such new piping sub comprises:

(i) a hollow elongate mandrel having a hollow bore and an uphole side and a downhole side;

(ii) a series of ports, each situated at a specific axial distance along the mandrel circumferentially spaced about a periphery of the mandrel;

(iii) a slidable annular hollow sleeve, slidably moveable from a first closed position covering the series of ports to a second open position in which the series of ports are uncovered;

(iv) an associated plurality of finger members each having a tab at a distal end thereof which is radially outwardly biased, each of the tabs having a radially inwardly extending portion and a radially outwardly extending portion, wherein the plurality of finger members are coupled to or integrally formed with an uphole side edge of the sliding sleeve, with the finger members and the tabs together configured to receive a protuberance from an actuating tool so as to permit the sliding sleeve to be moved by a protruding protuberance on the tool from the first open position to the second closed position;

(v) a first annular groove in an interior surface of the hollow mandrel, adapted to receive the radially outwardly extending portion of each tab when the sliding sleeve is in said first closed position so as to releasably retain the sliding sleeve in the first closed position;

(vi) a second annular groove in an interior surface of the hollow mandrel of greater radial depth than the first annular groove, adapted to receive the radially outwardly extending portion of each tab therein when the sliding sleeve is in said second open position so as to releasably retain the sliding sleeve in the second open position when a tool and protuberance thereon moves the sliding sleeve to the second position;

wherein when said sliding sleeve is moved by the tool from the first closed position to the second open position, the radially outwardly extending portion of the tab on each of the finger members is adapted to enter the second annular groove and be positioned therein to such a depth that the inwardly extending portion of each tab releases from engagement the protuberance on said tool, and the tool is then thereafter free to travel further uphole in the mandrel and the sliding sleeve remains retained in the second open position.

For further explanation and description of the scope of the aforementioned embodiments of the invention, reference is to be had to the remainder of this specification.

DRAWINGS

Further advantages and permutations and combinations of the invention will now appear from the above and from the following detailed description of various particular embodiments of the invention, taken together with the accompanying drawings each of which are intended to be non-limiting, in which:

FIG. 1A-1D are a series of sequential schematic views of a wellbore when fracking operations are desired to be carried out using the tool, system, and method of the present invention, and more particularly wherein:

FIG. 1A is a schematic side view of a wellbore adapted to allow use of the tool and method of the present invention, showing an initial step in the method of the present invention where the tool is inserted via continuous tubing downhole to a distal end of the wellbore;

FIG. 1B is a similar schematic side view, showing a subsequent step in the method of the present invention, wherein the tool has been actuated, and after being pulled uphole, has opened a most distal sliding sleeve on the well casing;

Figure 1A:
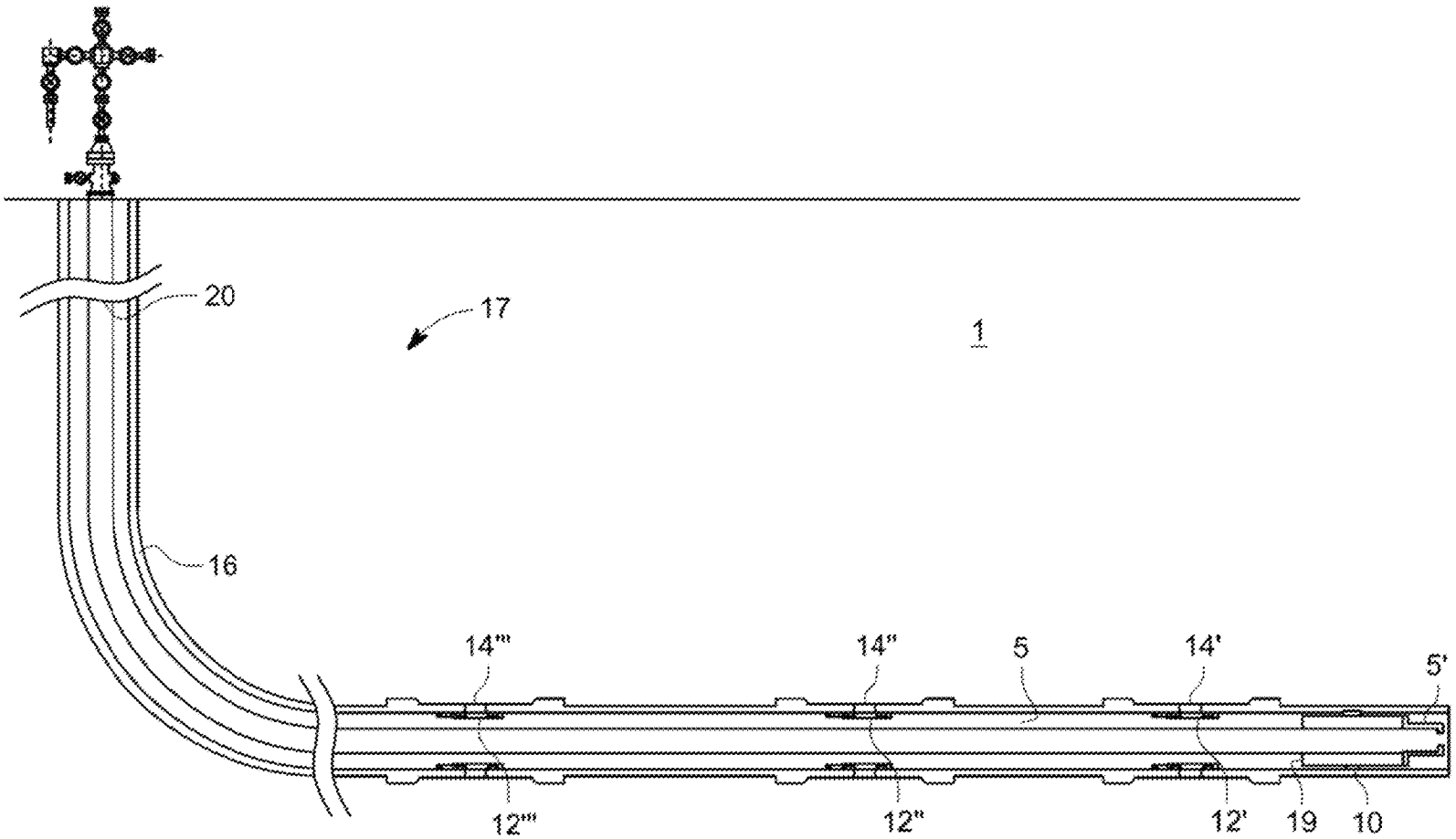
Figure 1B:
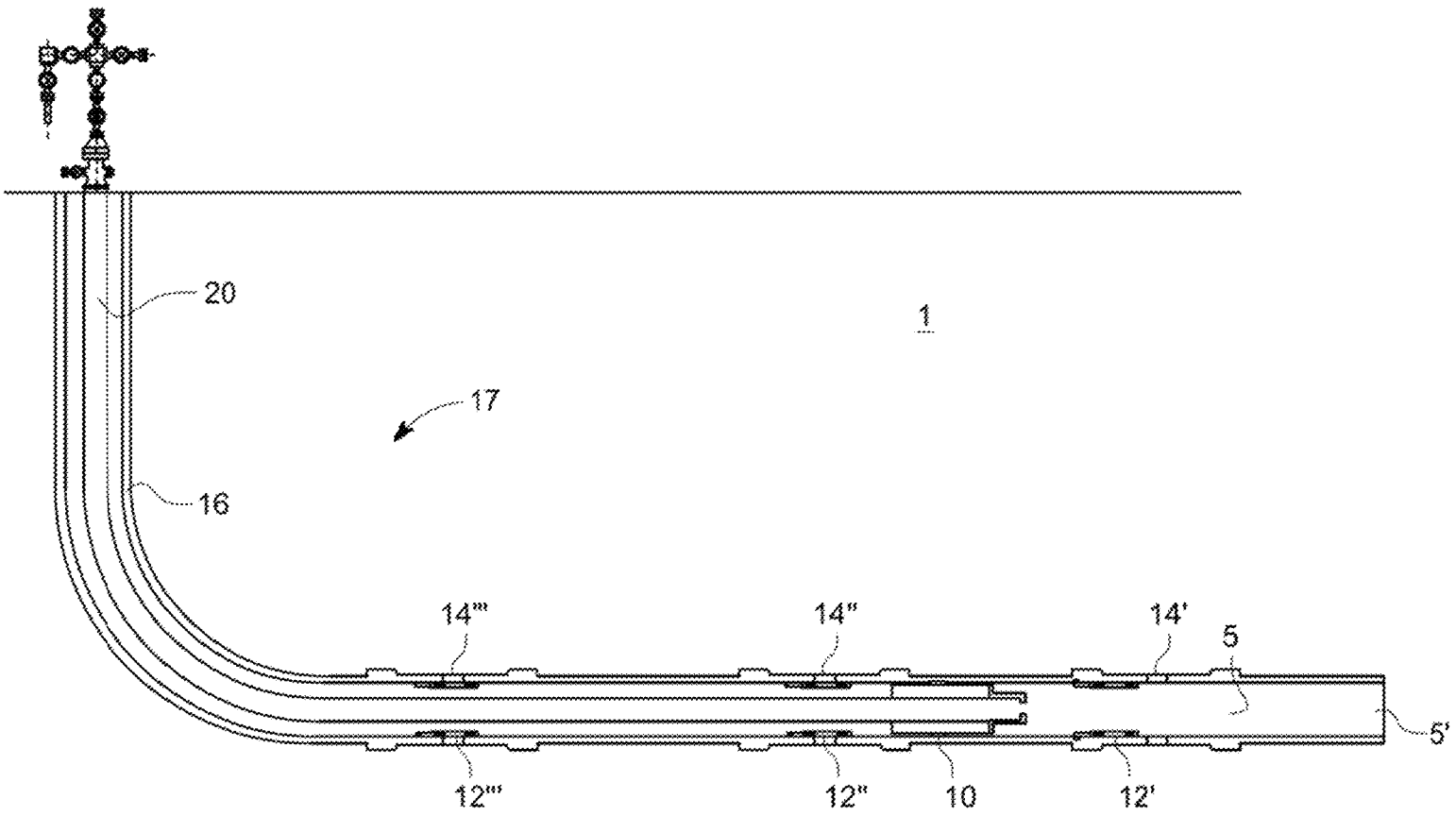
Figure 1C:
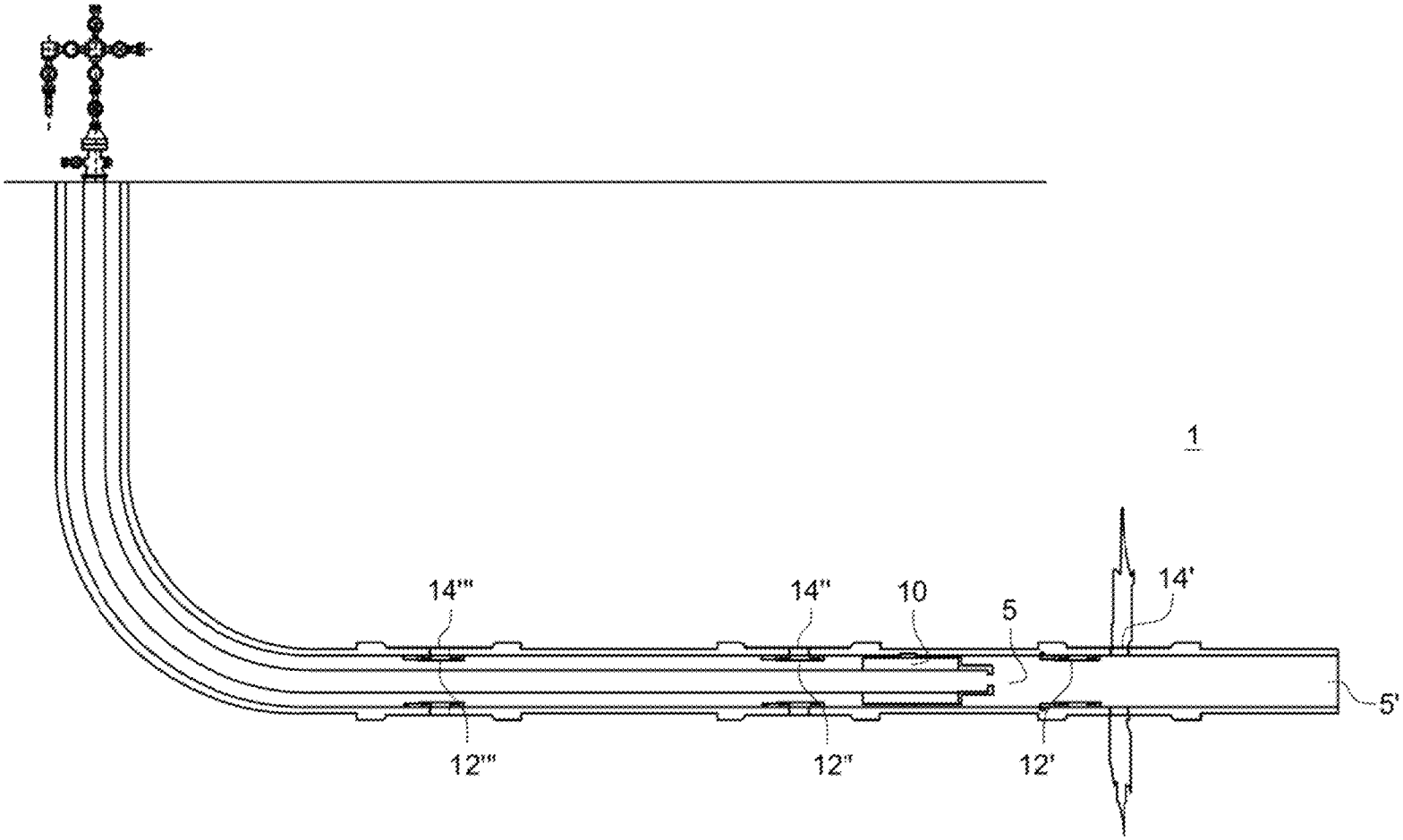
Figure 1D:
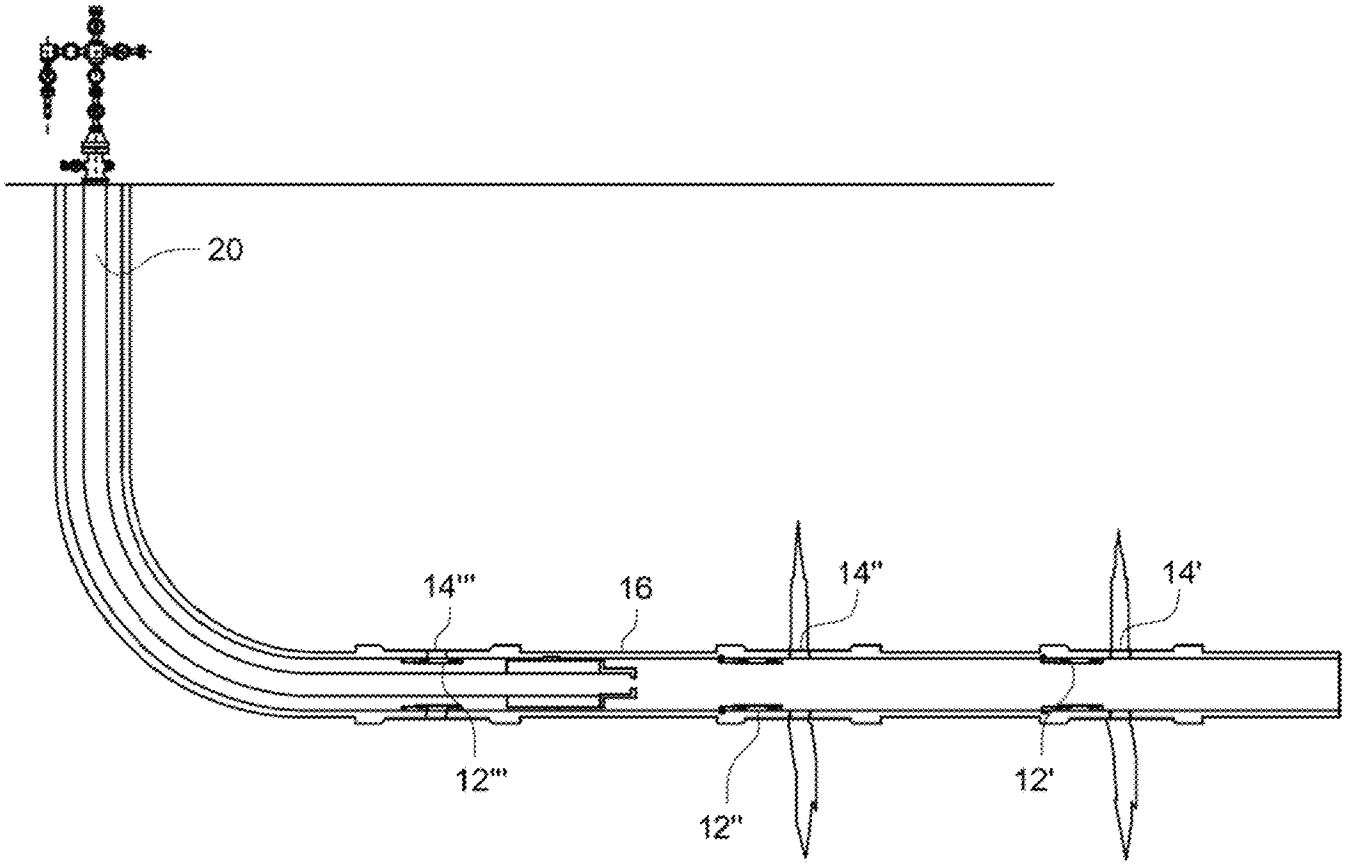
Figure 1E:
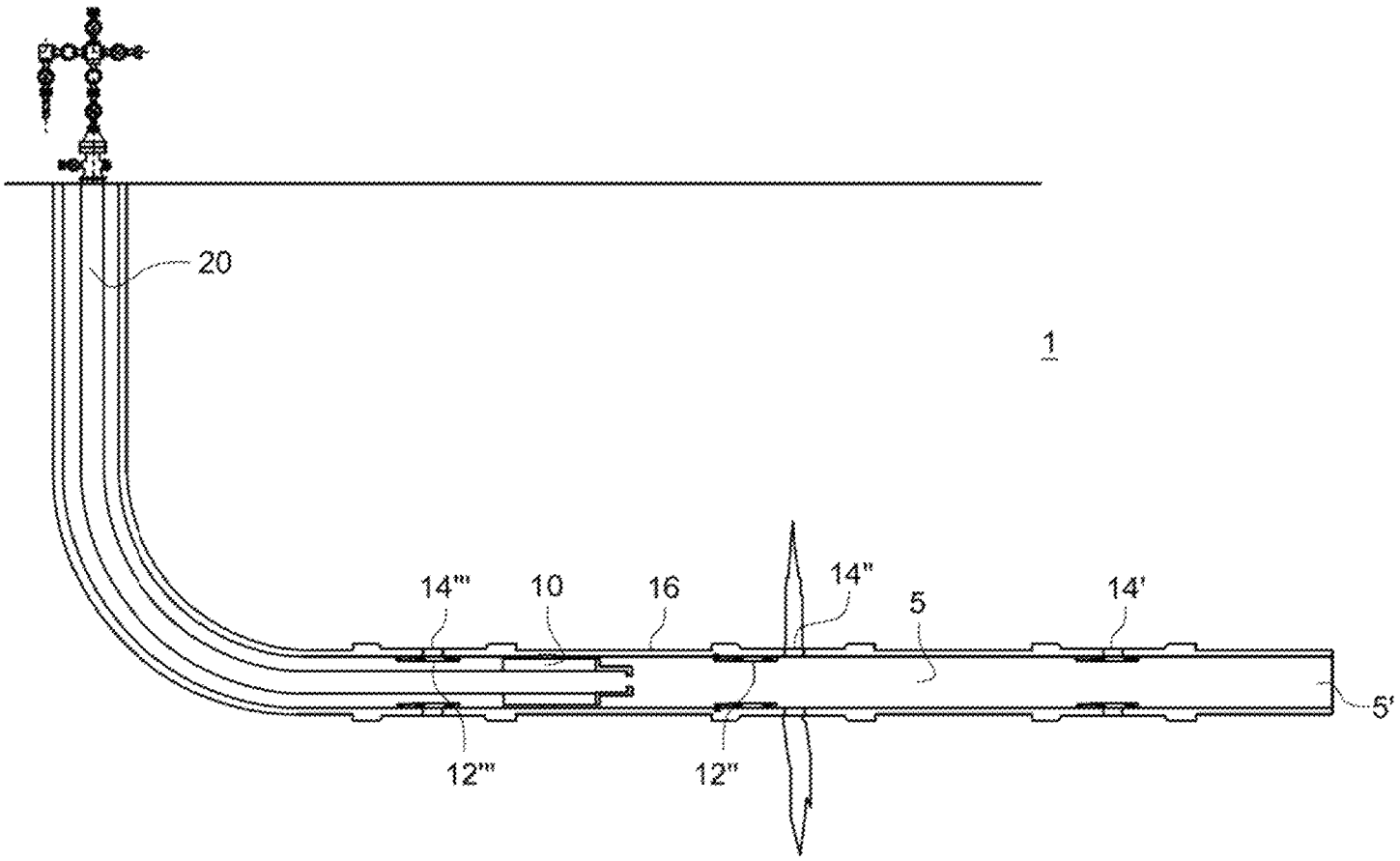

FIG. 1C is a similar schematic side view showing an subsequent step in the use of the tool and method of the present invention, wherein high pressure fluid has been flowed into continuous tubing affixed to the tool, and a portion of the underground formation in a region proximate the opened sleeve is in the process of being fracked; and FIG. 1D is a similar schematic side view showing a subsequent step in the use of the tool and method of the present invention, where a cluster (i.e. at least two) sliding sleeves have been opened, and fracking of the wellbore in such location is being conducted; and FIG. 1E is a similar schematic side view, showing an alternative means of proceeding with individual fracking at each sliding sleeve once a first distal sliding sleeve has been opened, namely showing the initial distal sliding sleeve having been closed using the tool, the tool having been pulled uphole and having opened the more-uphole sliding sleeve, and thereafter proceeding to inject fluid into the formation via the opened port at the more-uphole second sliding sleeve location.

Figure 2A:
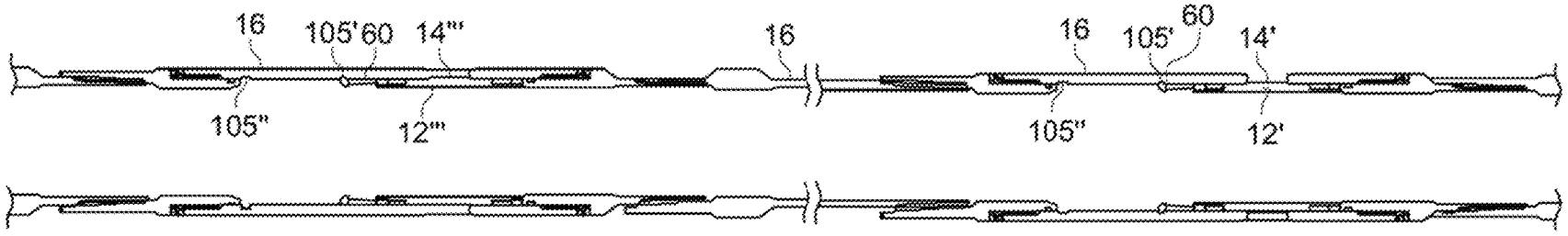
Figure 2B:
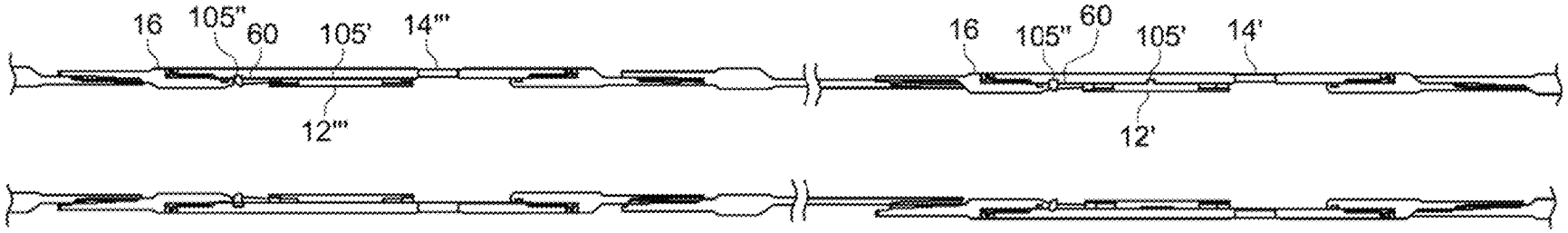
Figure 3:
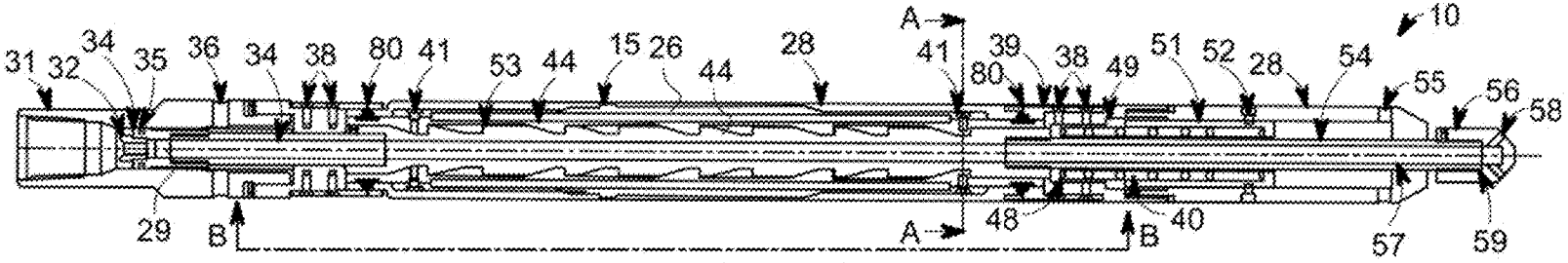
Figure 3B:
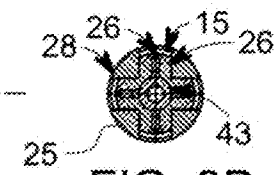
Figure 3A:
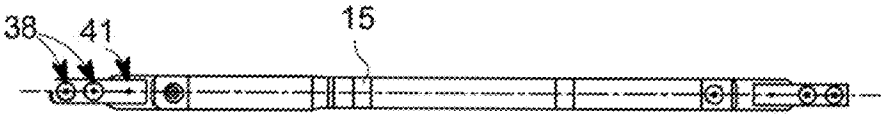
Figure 4:
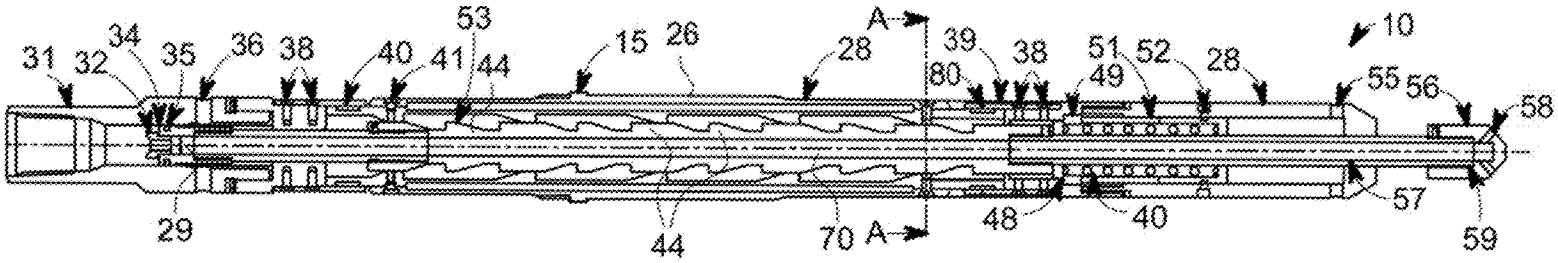
Figure 5:
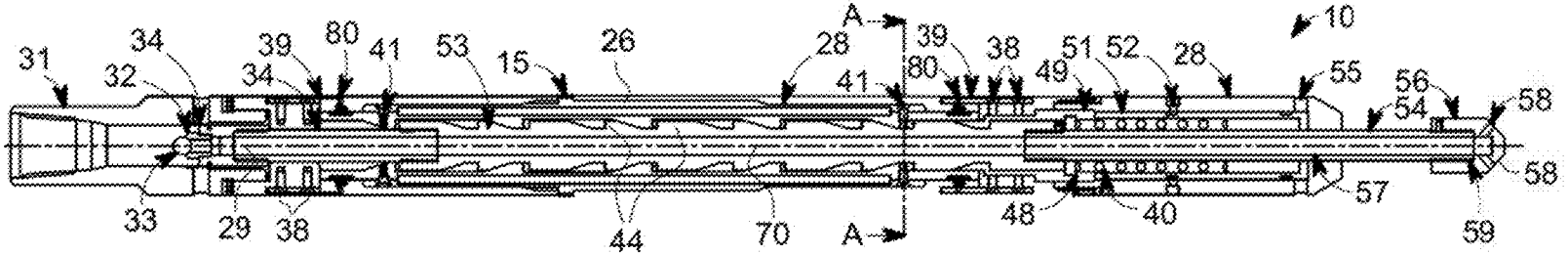
Figure 6:
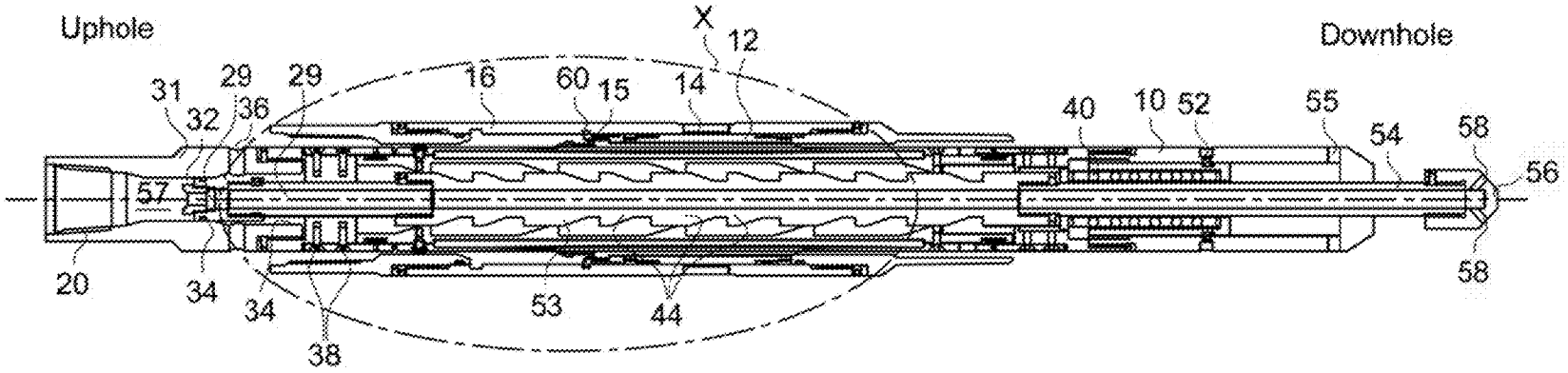
Figure 7:
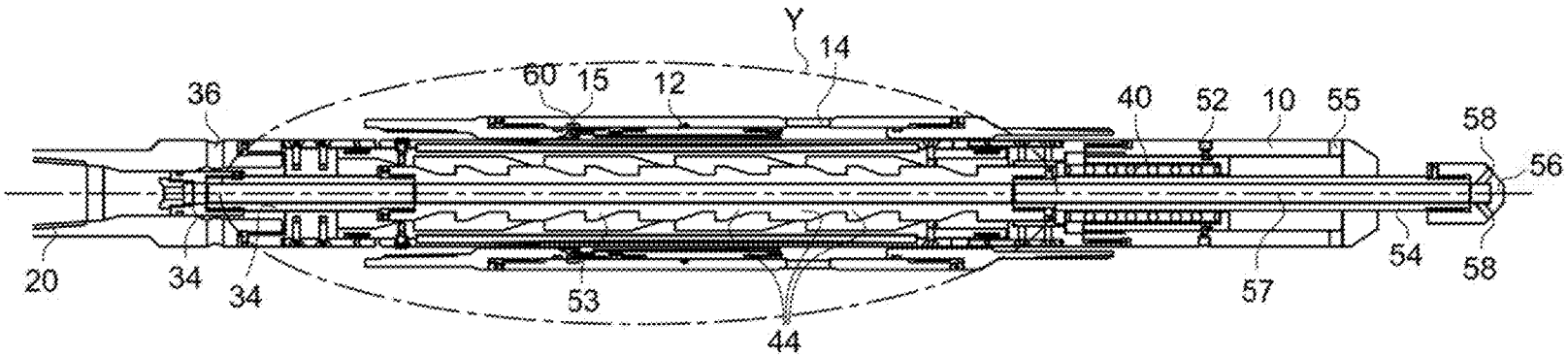
Figure 8:
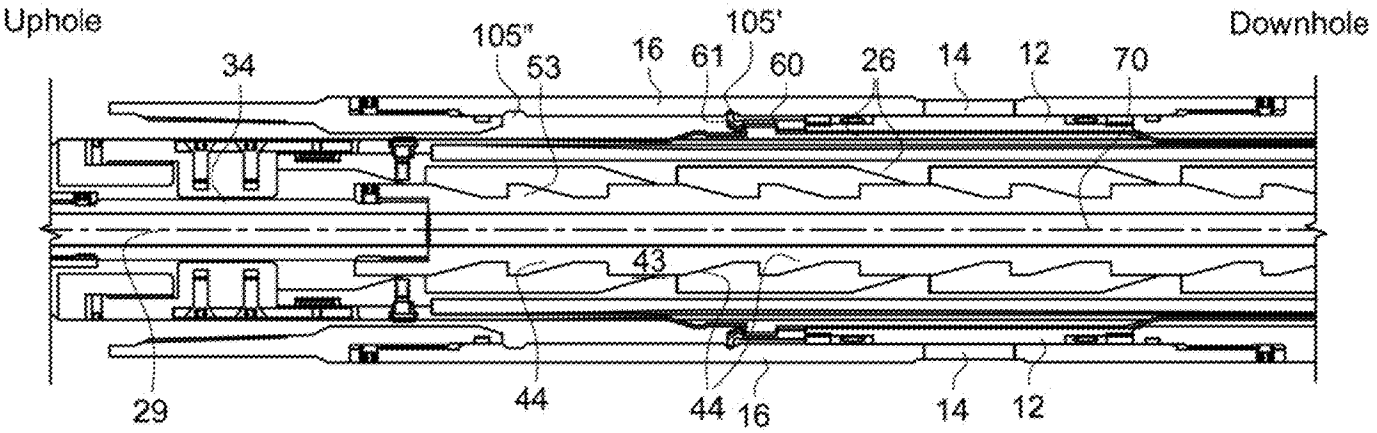
Figure 9:
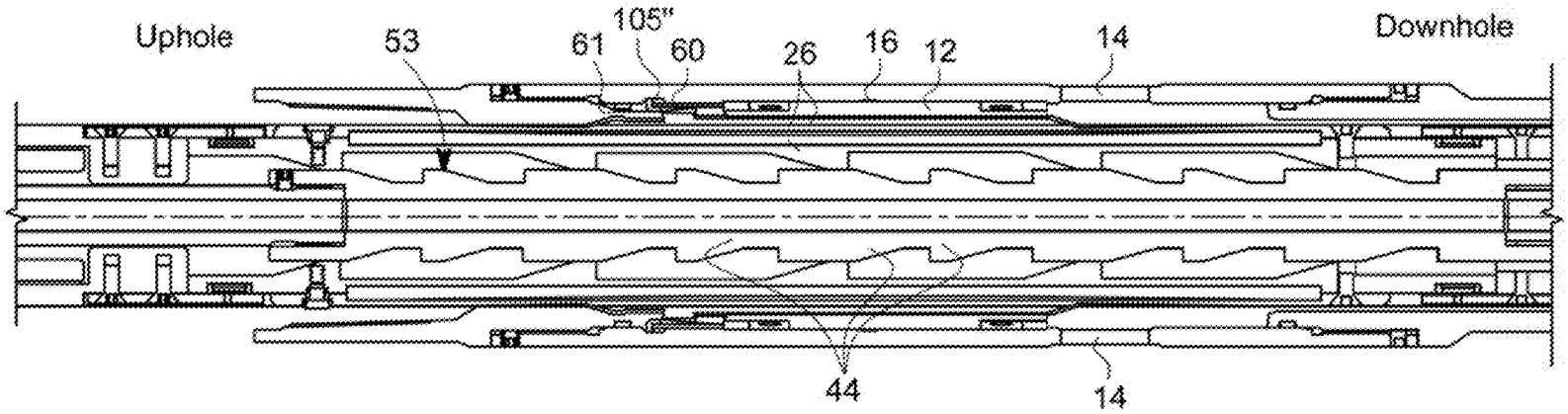
Figure 10A:
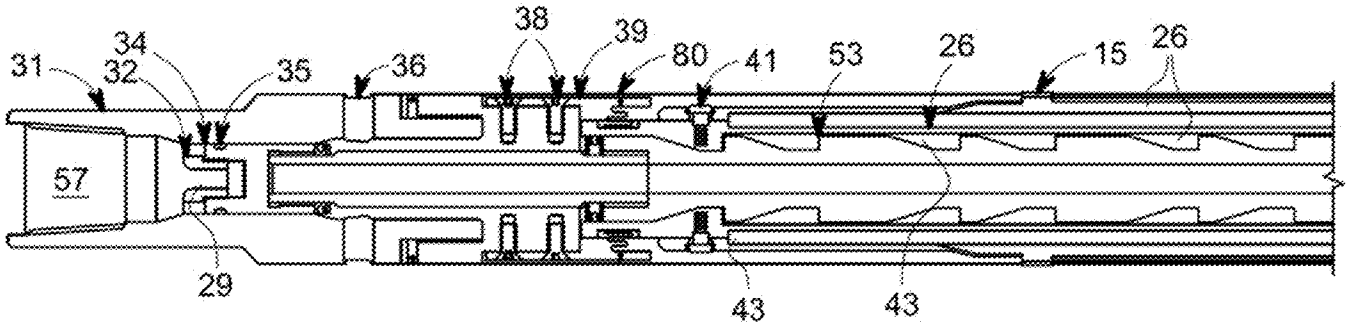
Figure 11A:
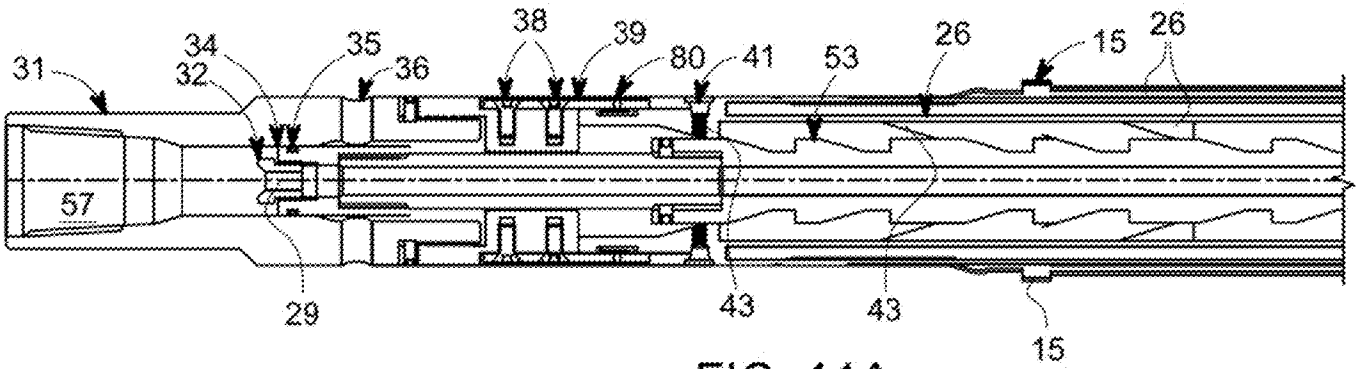
Figure 12A:
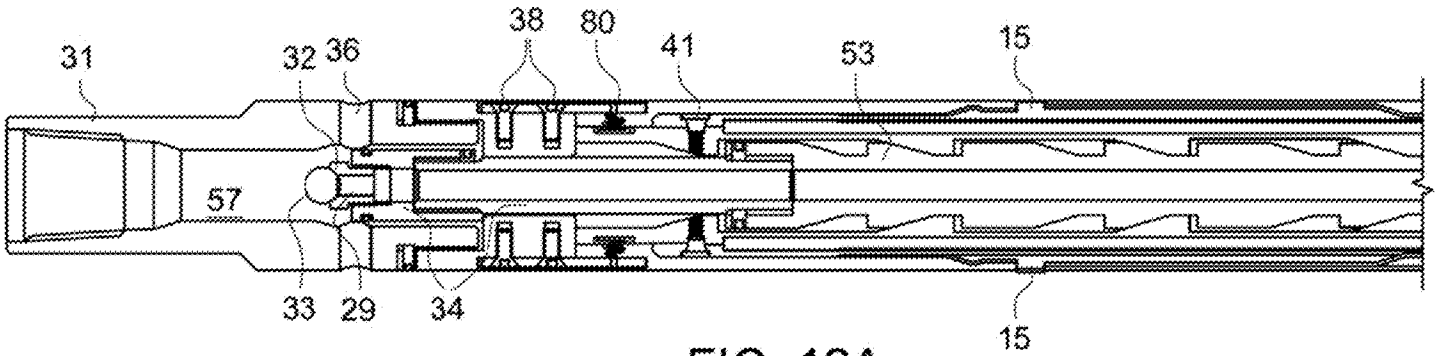
Figure 10B:
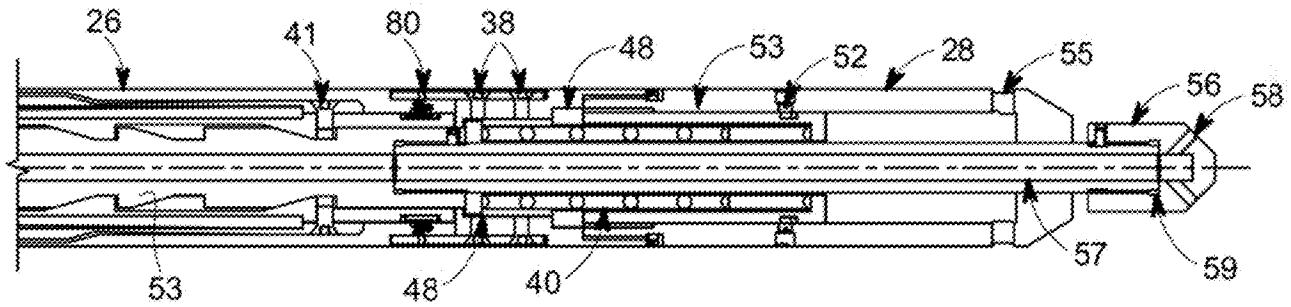
Figure 11B:
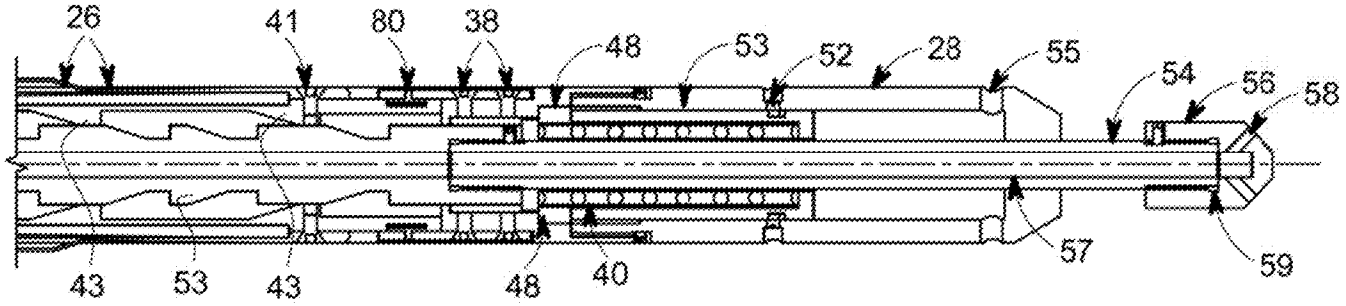
Figure 12B:
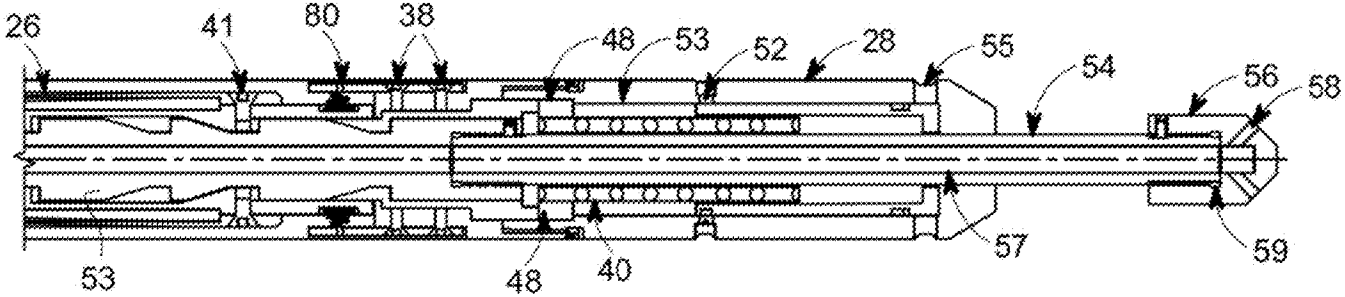
Figure 13:
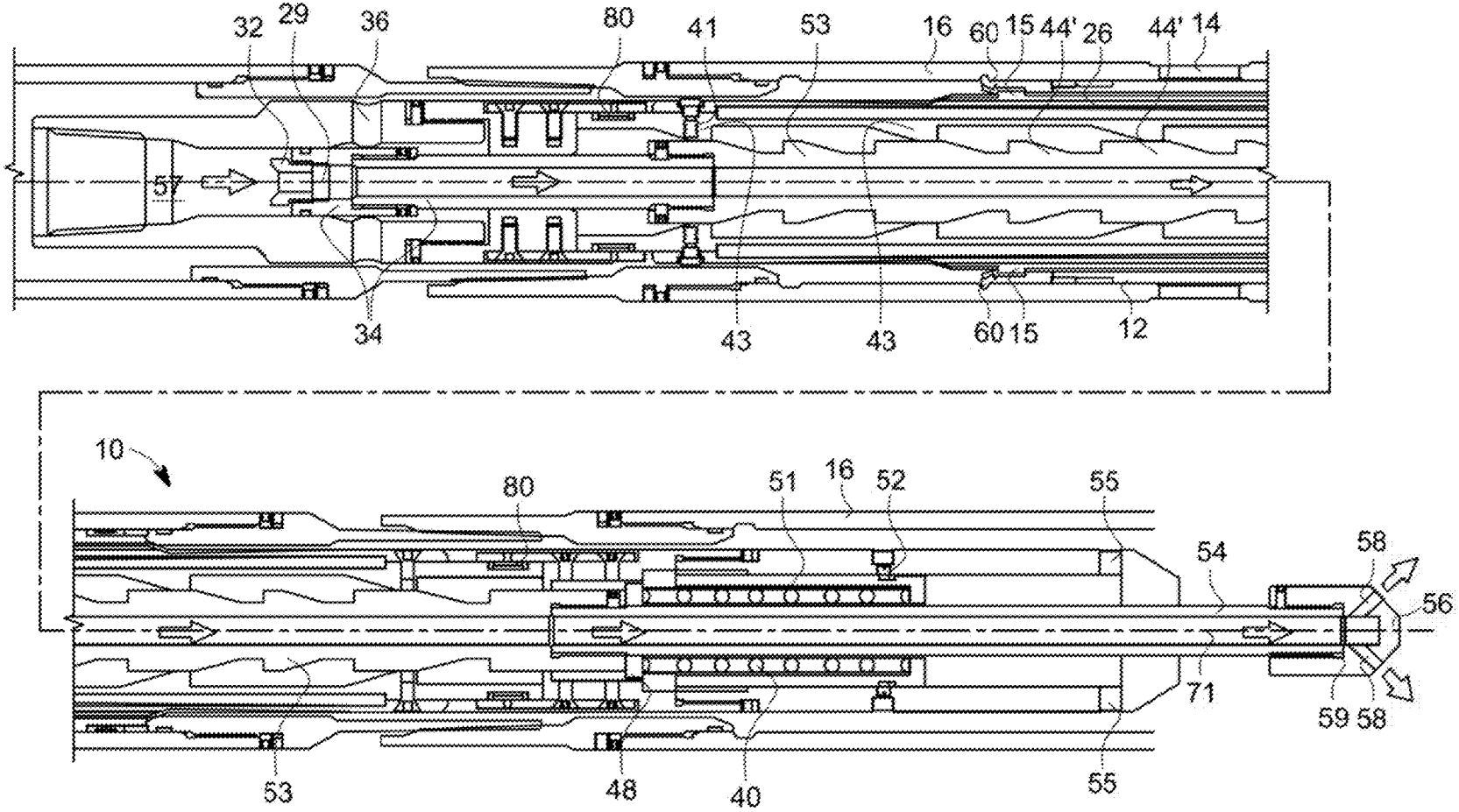
Figure 14:
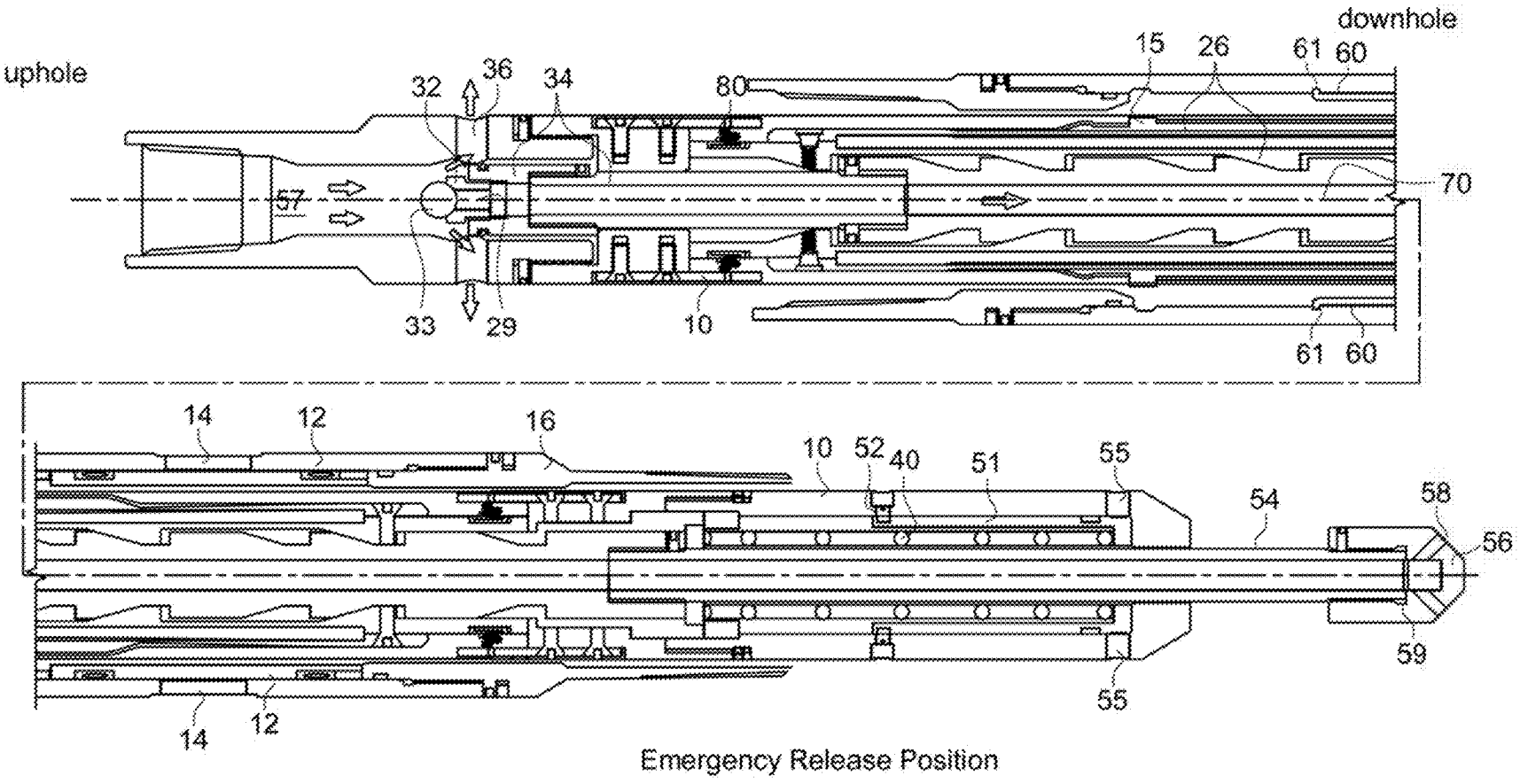
Figure 15A:
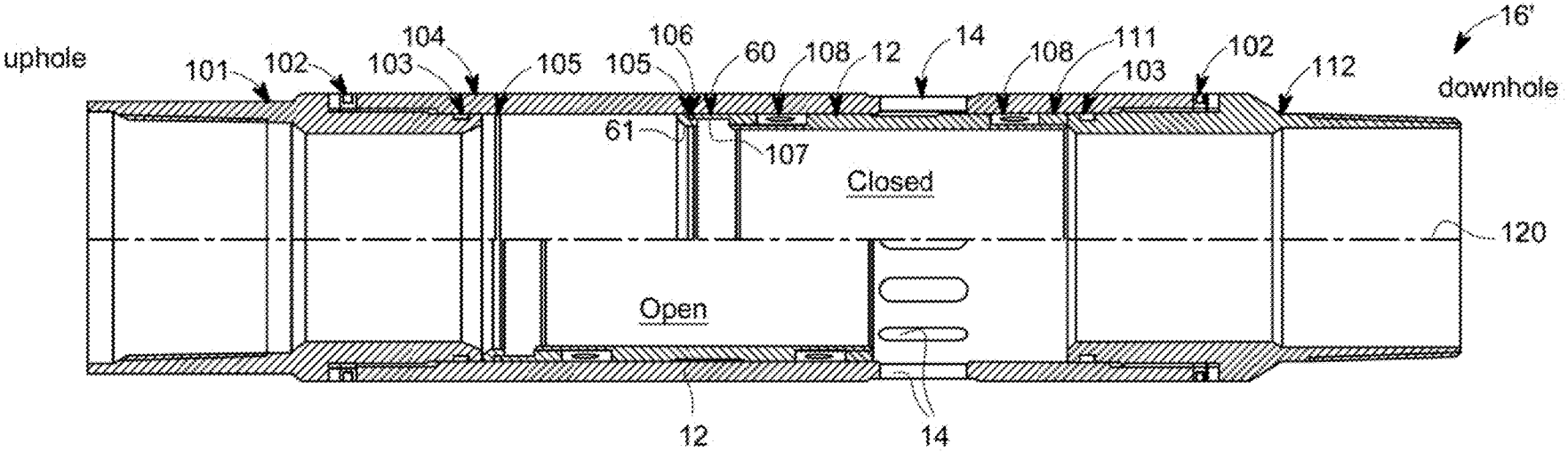
Figure 15B:
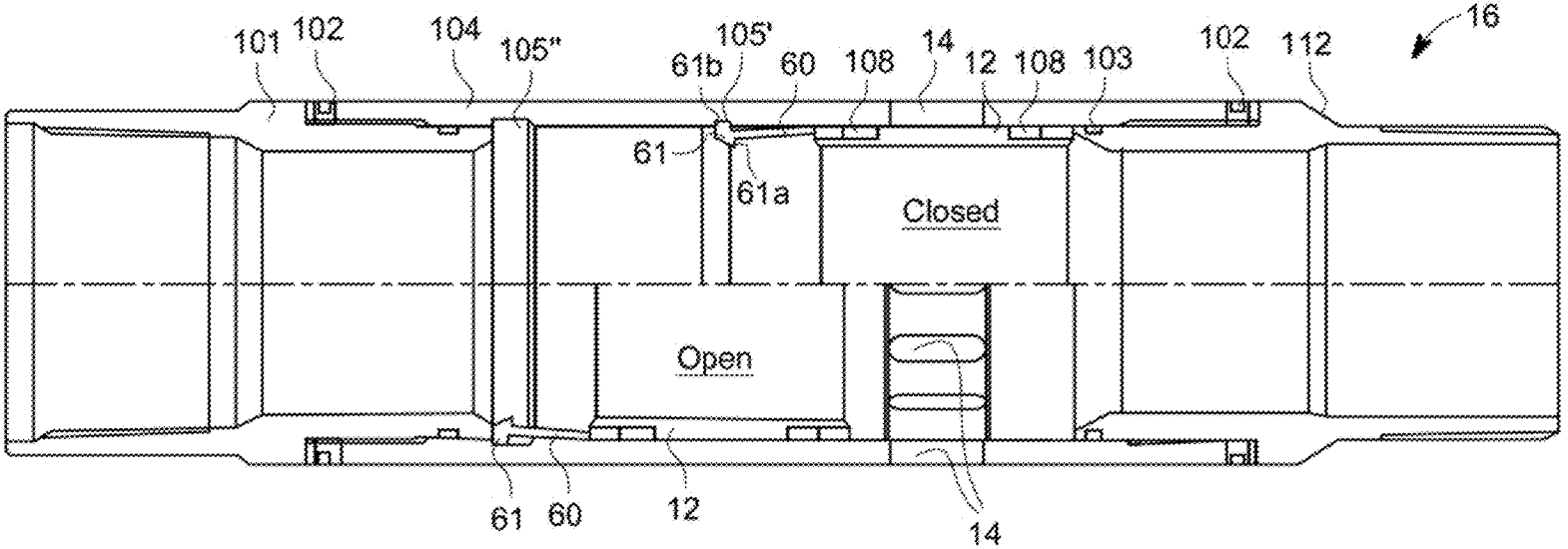

FIG. 2A is a cross-sectional view of a typical well casing suited for use of the tool of the present invention, which initially has a series of sliding sleeves covering a corresponding plurality of ports situated in piping assembled and positioned in a wellbore;

FIG. 2B is a similar cross-sectional view of a typical well casing suited for use of the tool of the present invention, wherein the series of sliding sleeves have each been opened by the tool of the present invention to allow fracking via the corresponding plurality of ports in the well casing and thereafter production from the wellbore via said opened ports;

FIG. 3 is a cross-sectional view of one embodiment of the tool of the present invention, showing the tool in the "run-in" (i.e. not actuated) condition, with the protuberances on the collets retracted and the spring in a substantially non-compressed or slightly compressed condition;

FIG. 3A is a view on plane B-B of FIG. 3;

FIG. 3B is a view on plane A-A of FIG. 3;

FIG. 4 is a cross-sectional view of the embodiment of the tool shown in FIG. 3, but instead showing the tool in the "actuated" condition with protuberances on the collets extended, and the spring in a substantially compressed condition;

FIG. 5 is a cross-sectional view of the embodiment of the tool shown in FIG. 3, but instead showing the tool in a further "emergency release position, with protuberances on the collets retracted, the moveable piston compressed to allow flow of fluid through the associated port, and shear screws having been sheared to allow the spring member to be non-compressed;

FIG. 6 is a schematic view of the system of the present invention, showing the tool of the present invention positioned by continuous tubing within well casing that as a port therein that is desired to be opened, wherein the tool has been actuated and the tool positioned so as to engage and grasp the sliding sleeve prior to upward movement on the tool;

FIG. 7 is a similar view of the system of FIG. 6, showing a subsequent step in operation of the system wherein the tool, now in engagement with the sliding sleeve, has been pulled uphole, thereby causing the sliding sleeve to uncover the associated port in the casing to thereafter allow fracking or production through the opened port to occur;

FIG. 8 is an enlarged view of the area "X" of the sleeve opening system shown in FIG. 6;

FIG. 9 is an enlarged view of the area "Y" of the sleeve-opening system shown in FIG. 7;

FIG. 10A is an enlarged view of the most-uphole portion of the tool of FIG. 3 (when in the "run-in" position and de-actuated);

FIG. 10B is an enlarged view of remaining downhole portion of the tool of FIG. 3 (when in the "run-in" position and de-actuated);

FIG. 11A is an enlarged view of the most-uphole portion of the tool of FIG. 4 (when in the "actuated" position);

FIG. 11B is an enlarged view of remaining downhole portion of the tool of FIG. 4 (when in the "actuated" position);

FIG. 12A is an enlarged view of the most-uphole portion of the tool of FIG. 5 (when in the "emergency release" position);

FIG. 12B is an enlarged view of the remaining downhole portion of the tool of FIG. 5 (when in the "emergency release" position);

FIG. 13 is a still further enlarged view of the tool shown in FIG. 8 shown within the well casing (when in the actuated position);

FIG. 14 is an combined enlarged view of the tool halves as shown in FIG. 12A, 12B, shown within the well casing (in the emergency release position);

FIG. 15A is a cross-section of a well casing operable with a tool of the present invention and incorporating one embodiment of the system of the present invention, shown at a location of a port therein and showing the associated sleeve in the closed position (top-half) and in the open position (bottom half); and FIG. 15B is a cross-section of an alternative embodiment of a well casing operable with a tool of the present invention and using another embodiment of a system of the present invention, shown at a location along the piping where a sleeve is the closed position (top-half) covering the associated port and when the sleeve is in the open position (bottom half) and the port is uncovered.

To facilitate understanding, identical reference numerals have been used, where possible, in each of the appended figures, to designate identical elements that are common to the figures.

It is further contemplated that elements disclosed in one embodiment may be beneficially utilized on other embodiments without specific recitation.

Corresponding reference numerals indicate corresponding parts throughout the several views of the drawings.

DETAILED DESCRIPTION

Example embodiments will now be described more fully with reference to the accompanying drawings.

FIG. 1A-1E show a series of sequential schematic views of a wellbore 5 when fracking operations are being carried out using the tool 10, system 17, and piping assembly of the present invention.

With reference principally FIG. 1A-1E of the drawings, when desiring to frack and subsequently produce hydrocarbons from an underground formation 1, the tool 10 of the present invention is adapted to open and close sliding sleeves 12', 12", 12'" which respectively cover and uncover successive associated ports 14', 14", 14'" spaced along a piping or casing 16 within wellbore 5 in a hydrocarbon formation 1.

FIG. 1A shows the initial sequence in the method of the present invention using the system 17 and tool 10 of the present invention, wherein the tool 10, attached to the distal end 19 of continuous tubing 20, is lowered into the wellbore 5, causing sliding sleeves 12', 12", 12'" (if not already in such position) to cover associated respective ports 14', 14", 14" in piping 16 along wellbore 5, until such point as tool 10 reaches or is proximate a distal end 5' of wellbore 5.

FIG. 1B shows a subsequent step in the method of the present invention, whereby pressurized fluid has been supplied to the tool 10, causing the tool 10 to have actuated radially outwardly-extendable protuberances 15 thereon (see for example enlarged view of FIGS. 5 & 6) and thereafter been pulled uphole to engage and slidably move sliding sleeve 12' uphole so as to uncover associated port 14', thereafter becoming disengaged from sliding sleeve 14'.

FIG. 1C shows a subsequent step in the method of the present invention, whereby pressurized fluid has been supplied via and through tool 10 to opened port 14', thereby allowing formation 1 to be fracked in the region of opened port 14'.

FIG. 1D shows a subsequent step in the method of the present invention, whereby tool 10 has thereafter been and pulled uphole to engage and slidably move sliding sleeve 12" uphole so as to uncover associated port 14", thereafter becoming disengaged from sliding sleeve 14" and after having been moved further uphole, pressurized fluid has been supplied via and through tool 10 to opened port 14", thereby allowing formation 1 to be fracked in the region of second opened port 14".

FIG. 1E shows an alternate subsequent step in the method of the present invention following the step shown in FIG. 1C, whereby tool 10 has, after fracking been completed at opened port 14', been again lowered downhole so as to engage and close sliding sleeve 14', fluid pressure then removed from being supplied to tool 10 and consequently protuberances 15 thereon (not shown in this schematic but clearly shown in for example FIG. 4) been radially retracted, the tool then pulled uphole leaving the port 14' in a closed position, fluid pressure resupplied to tool 10 so as to radially extend protuberances 15 thereon and thereafter pulled uphole to engage and slidably move sliding sleeve 12" uphole so as to uncover associated port 14" (as shown in FIGS. 5 & 6), thereafter becoming disengaged from sliding sleeve 14" and after having been moved further uphole, pressurized fluid has been supplied via and through tool 10 to opened port 14" thereby allowing formation 1 to be fracked in the region of second opened port 14".

FIG. 2A is an enlarged partial view of FIG. 1A, showing all sliding sleeves 12', 12'" in the closed position, and FIG. 2B is an enlarged partial view of the same piping 16 with the sleeves 12', 12'" shown in an open position uncovering associate ports 14', 14".

The embodiment of the piping assembly 16 shown in FIGS. 2A & 2B, is preferably an embodiment of piping most clearly shown in FIG. 15B, namely an embodiment where each of the sliding sleeves 12', 12''' possess further tabbed radially-outwardly biased finger members 60, the outwardly protruding tabs 61 of radially-outwardly biased finger members 60 shown in FIG. 15B being adapted to engage a first shallow recessed annular groove 105' in the interior of the piping 16 proximate respective port 14', 14''' when the associated sliding sleeves 12', 12''' are in the closed position.

The piping sub 16 of FIG. 15B (with like components similarly identified in piping sub 16' shown in FIG. 15A) comprises a hollow elongate mandrel 104, which may having a hollow bore 120 and an uphole end and a downhole end, and which may further have a threaded coupling member 101 at the uphole end secured thereto by set screws 102 and a similar threaded coupling member 112 coupled at a downhole end and likewise threadably secured thereto by set screws 102, to allow coupling of such piping sub 16 to a piping string within a wellbore. An "o" ring member 103 may further be provided around a circumference of each threaded coupling member 101, 102.

A series of ports 14 are provided within mandrel 104, each situated at a specific axial distance along mandrel 104 and circumferentially spaced about a periphery of mandrel 104.

A slidable annular hollow sleeve 12, slidably moveable from a first closed position covering the series of ports 14 to a second open position in which the series of ports 14 are uncovered, is provided within mandrel 104 of piping sub 16. A pair of spaced-apart bi-directional sleeve seals 108 are provided on sleeve 12, adapted to provide a fluid seal on both the downhole and uphole sides of port 14 when sleeve 12 is positioned to cover port 14. A sleeve retainer 111 may further be provided to retain the most downhole sleeve seal 108 on sleeve 14, and allow replacement thereof should such seal 108 become worn (at the opposite uphole end, finger members 60 may also be decoupled, such as by threaded decoupling from sleeve 12, in order to facilitate replacement of any worn bi-directional seal 108).

An associated plurality of finger members 60 having a tab 61 at a distal end thereof which is radially outwardly biased, are provided at an uphole end of each sliding sleeve 12. Each of tabs 61 have a radially inwardly extending portion 61*a* and a radially outwardly extending portion 61*b*. The plurality of radially outwardly biased finger members 60 are coupled to or integrally formed with an uphole side edge of the sliding sleeve 12, with the finger members 60 and the tabs 61 thereon together configured to receive a protuberance 15 from an actuating tool 10 so as to permit the sliding sleeve 12 to be moved by a protruding protuberance 15 on the tool 10 from the first open position to the second closed position.

A first annular groove 105' is provided in an interior surface of hollow mandrel 104—such first groove 105' adapted to receive the radially outwardly extending portion 61*b* of each tab 61 when the sliding sleeve 12 is in the first closed position so as to releasably axially retain the sliding sleeve 14 in the first closed position.

A second annular groove 105" is provided in an interior surface of hollow mandrel 104 typically of greater radial depth than the first annular groove 105', adapted to receive the radially outwardly extending portion 61*b* of each tab 61 therein when the sliding sleeve 12 is in said second open position so as to releasably retain the sliding sleeve 12 in the second open position when a tool 10 and protuberance 15 thereon moves the sliding sleeve 12 to the second position.

In operation, and highly advantageously, and with reference to both FIGS. 1A-1E and FIG. 15*b*, protuberances 15 on collets 26 on tool 10 (when such tool 10 is actuated and moved uphole) engage sliding sleeve 12 at a location adjacent, but immediately downhole of, protruding tab 61 [ref. for example FIGS. 6 & 13 (top view)]. When sliding sleeve 12 has thereafter been moved uphole by tool 10 within piping sub 104 to thereby open port 14 (ref. FIG. 7), the radially outwardly extending portion 61*b* of tab 61 on each of the finger members 60 is adapted to enter the second (deeply recessed) annular groove 105" and be positioned therein to such a depth that the inwardly extending portion 61*a* of each tab 61 releases from engagement therewith the protuberance 15 on the tool 10 (ref. FIG. 7). Tool 10 is thus thereafter free to continue to travel further uphole in piping 16, and the sliding sleeve 12 remains retained in the second open position by the finger members 60 engaging the second annular groove 105" on an interior surface of piping 16. No de-actuation of tool 10 is thus needed to cause protuberances 15 to be withdrawn back into tool 10. Rather, tool 10 (with protuberance 15 thereon extended and the tool continually in the actuated position) can continue to be raised uphole and the process repeated at uphole port 14'. Tool 10 may further thereby move further uphole sleeves and thereby open further associated uphole ports 14", 14" for fracking as it progresses upward within piping 16, thus greatly speeding fracking operations as tool 10 progresses upward within piping 16. Alternatively the injection of fluid be carried out later after all desired ports have then been opened, thus also speeding fracking operations.

In a less preferred embodiment, such as shown in FIG. 15A a piping 16' and in particular the finger members 60, may have an outwardly biased detent 106 on tab 60 at distal end of finger members 60, which is adapted to engage, when sleeve 12 is in the closed position, a minimally-recessed annular groove 105 as shown in the embodiment of the piping 16' shown in FIG. 15A so as to releasably retain sleeve 12 in the closed position.

Tab 60 in such embodiment forms an annular groove 107 in each of finger members 60 to accommodate and allow engagement with biased protuberance 15. Thus when desiring to move sleeve 12 via tool 10 to open an associated port 14, uphole movement of tool 10 causes extended protuberances 15 on collets 26 on tool 10 to engage sliding sleeve 12 in annular groove 107 situated in finger members 60, allowing tool 10 to grasp sliding sleeve 14 (which is coupled to or integrally formed with sliding sleeve 12) and move it uphole so as to uncover port 14. Upon movement of sleeve 12 to the open position, a detent member 106 on finger member 60 engages a second annular groove 105, so as then to retain sleeve in an open position. In such embodiment, the finger members 60 do not automatically become disengaged from protuberance 15 in groove 107, and tool 10 need be de-actuated in order allow protuberances 15 to be withdrawn before tool 10 can be further moved uphole past opened sleeve 12. Once moved past opened sleeve 12 tool 10 will again need to be reactivated before being able to engage and thereafter open another uphole sleeve 12'.

FIGS. 3-3*b*, 4 & 5 show a sleeve-actuating tool 10 of the present invention in respectively three (3) separate configurations, namely a "run-in" non-actuated condition shown in FIG. 3, an actuated configuration shown in FIG. 4, and an emergency release configuration shown in FIG. 5.

In the below following description reference is to be had to not only FIGS. 3-3B, 4 & 5, but also to remaining FIGS. 6, 7, 8, 9, 10 & 10B, 11A & 11B, 12A & 12B, 14, 14 & 15A-15B, where the following further figures show enlargements of the various 3 separate configurations of tool 10 specifically as follows:

| | |
|---|---|
| Run-In Configuration | FIG.'s 3, 3A, 3B, 10A & 10B |
| Actuated Configuration | FIG's 4, and 6, 7, 8, 9, 11A & 11B, 13 |
| Emergency Release/ Flushing Configuration | FIG's 5, and 12A & 12B, 14 |

Details of the tool 10 and manner of operation will now be described with reference to the above figures.

In each of the three configurations of tool 10, tool 10 comprises an elongate hollow mandrel 28, which may be comprised of one or more hollow mandrels 28 or hollow sub members weldably or threadably coupled together. Mandrel 28 has a longitudinal bore 57 and an outer periphery 25, and is coupleable at an uphole (top sub) end 31 to a distal end of continuous tubing 2. Mandrel 28 is adapted to be in fluid communication with the continuous tubing 20.

An elongate actuating piston member 34 is provided within bore 57 of mandrel 28 itself having a longitudinal bore 29 and situated in longitudinal bore 57 of mandrel 28 proximate an uphole end 31 thereof and axially slidable within the longitudinal bore 57 of mandrel 28. An o-ring seal 35 may be provided about the circumference of piston member 34. The mandrel 28 has an outer periphery 25.

A plurality of longitudinally-extending, circumferentially-spaced collets 26, each having a camming surface 43 on an interior elongate surface thereof and each having a radially-outwardly extending protuberance 15 on an outer periphery, are provided. Protuberances 15, when actuated, resiliently extend radially outwardly from the outer periphery 25 of the mandrel. As seen from Section A-A (i.e FIG. 3B) and view B-B on FIG. 3 (i.e. FIG. 3A) retainer screws 38 are provided at each end of collets 26, and a biasing spring 80 is provided to bias collets 26 in a radially outward direction. A spring retainer member 39 is provided, secured by retainer screws 38, to secure biasing spring 80. Shoulder screws 41 retain shoulder edges of radially outward portions of collets 26 with the underside camming surface 43 of collets 26.

An elongate camming member 53 is further provided, having a longitudinal bore 70 preferrably co-axial with bore 57 of mandrel 28 and bore 29 of piston member 34. One or more cams 44 are situated on an exterior periphery thereof adapted for physical contact with said camming surface 43 on the elongate interior surface on each of the collets 26, the elongate camming member 53 coupled to piston member 34 and axially slidable within said longitudinal bore 57 of mandrel 28.

A spring member 40, such as a helical coil-spring member, is provided. Spring member 40 serves to bias both the elongate camming member 53 and the piston member 34 in an uphole direction within tool 10 along longitudinal bore 57 of mandrel 28 to a first axial position within the tool 10 such that elongate camming member 53 and cams 44 thereon allow protuberances 15 on collets 26 to each thereby be positioned in a radially-retracted position within the outer periphery 25 of mandrel 28. A spring bushing 48 is provided to secure one end of spring member 40.

In operation, when no fluid pressure is supplied to the tool 10 via the continuous tubing 20, the protuberances 15 on collet 26 are in a retracted position and remain within outer periphery 25 of mandrel 28, and the tool 10 is in a "run-in" configuration as shown in FIGS. 3, 10A (top portion of tool 10) & 10B (bottom portion of tool 10).

Upon fluid under a first pressure being provided in the continuous tubing 20 to an uphole end 31 of tool 10 for purposes of placing tool 10 in an actuated configuration as shown for example in FIG. 4 as can best be seen by comparing the tool configuration in the run-in condition in FIG. 10A (top portion of tool 10) with tool 10 in the actuated configuration (eg. FIG. 11A (top portion of tool 10)] and FIG. 13, application of such fluid pressure to tool 10 forces piston member 34 downhole in bore 57 of mandrel 28 and when forced downhole, is adapted to: (a) force the elongate camming member 53 to a second axial position more downhole than the first axial position thereby compressing or further compressing spring 40; and (b) cause cams 44 on elongate camming member 53 to likewise move longitudinally downhole and engage camming surface 43 on each of the longitudinally-extending collets 26 thereby causing protuberances 15 thereon to be forcibly pushed radially outwardly so as to cause them to each extend past outer periphery 25 of mandrel 28, for thereby permitting protuberances 15 to engage a sliding sleeve 12 in the manner explained below, to thereafter allow the tool 10 move and thereby open or close the sleeve as desired.

In a preferred embodiment of tool 10, the one or more cams 44 on elongate camming member 53 comprise at least one wedge-shaped member 44' as shown for example in FIG. 13, which is adapted to contact camming surface 43 on collets 26. Camming surface 43 on collets 26 may comprise a similar series of wedge-shaped members, or may be of an undulating or other profile which will allow, upon relative axial movement of elongate camming member 53 and cams 44 along such camming surface 43, the radially outward extension of protuberances 15, and when subsequently moved to a further axial position downhole, permit the subsequent radial inward contraction of the collets 26 and the respective protuberances 15 thereon.

In a preferred embodiment, as best shown in FIG. 13, the longitudinal axis of respectively (i) the longitudinal bore 57 of mandrel 28; (ii) the longitudinal bore 29 of the piston member 34; the longitudinal bore 70 of elongate camming member 53; and (iv) the longitudinal bore 71 of an extension mandrel 54 at a downhole end of the elongate camming member 53, are all longitudinally aligned and co-axial to permit passage of pressurized fluid through tool 10.

In a preferred embodiment mandrel extension 54 at a downhole end terminates in a jet nozzle 56 threadably coupled thereto, with the jet nozzle 56 having one or more jet ports 58 for directing pressurized fluid downhole, which jet ports may be used for flushing the wellbore immediately ahead of tool 10 when tool 10 is being lowered in wellbore 5 to aid in preventing lodging of tool 10 within wellbore 5, and may further or alternatively be used to supply fluid to a port 14 that is downhole of tool 10 but which tool 10 had moved to an open position uncovering a respective port 14 when fracking of a hydrocarbon formation 1 at the location of at least such one opened port 14.

In a further refinement and preferred embodiment of the tool, for the resulting advantages and further capabilities hereinafter explained tool 10 may further be provided with one or more radial ports 36 in mandrel 28 at an uphole end 31 thereof, which radial port(s) 36 is adapted to permit, when opened by slidable movement of piston member 34 in the manner explained below, to cause tool 10 to be configured in an "emergency release" configuration as shown in FIGS. 5, 12A, 12B & FIG. 14 and in particular to then permit flow of pressurized fluid from within longitudinal bore 57 of mandrel 28 to an exterior of mandrel 28 at an uphole end 31 of mandrel 28 in a region where sand typically builds up upon pulling of tool 10 from a wellbore.

In order to be able to achieve the desired objective of being able to configure the tool in this third configuration, namely such "emergency release" configuration so as to be able to provide a flushing fluid under high pressure at the precise location on tool 10 (namely an uphole end 31 thereof) that typically experiences the greatest amount of sand and detritius build-up when withdrawing tool 10 from a wellbore 5, in such preferred embodiment tool 10 and in particular piston member 34 thereof is provided at the most-uphole end with a plug seat 32. Plug seat 32 is adapted to receive therein a plug member 33 such as a ball which is flowed downhole to tool 10 via continuous tubing 20. When plug member 33 becomes seated in plug seat 32 plug member 33 then prevents flow of pressurized fluid through longitudinal bore of piston member 34 and causes the piston member 34 to then move to the third most-downhole position.

Due to spring member 40 only being intended to function so as to bias the piston member 34 uphole and not being intended to prevent piston member 34 from moving when needed to an emergency release position allowing egress of pressurized fluid to flow out of radial port 36 in a washing action, in a preferred embodiment a frangible release member such as shear screws 52, are further provided to releasably secure spring member 40. In the embodiment shown such securement of spring member 40 is via securement of a downhole end of spring 40 by shear mandrel 51 at one end thereof being secured to an outer periphery of mandrel 28 via shear screws 52 so as to prevent relative axial movement therebetween under normal tool actuated pressures. A stop ring 49 is provided to assist in locating shear mandrel 51 in mandrel 28.

Thus in such further refinement, as may be best seen from FIG. 14, upon plug member 33 being flowed downhole and onto plug seat 32 and fluid under a second fluid pressure being provided to tool 10 via continuous tubing 20, piston member 34 and elongate camming member 53 can then exert sufficient force on shear mandrel 51 so as to cause shear screws 52 to shear so as to permit axial downhole movement of shear mandrel 51 and thus the one end of spring member 40 is released from releasable securement thus: i) permitting both piston member 34 and elongate camming member 53 no longer being resisted by shear mandrel 51 and spring 50 to move axially downhole or further axially downhole in tool 10 to such third axially most-downhole "emergency release" position. Any fluid within mandrel 28 in the region of shear mandrel 51 will be caused by axial movement downhole of shear mandrel 51 to flow to the exterior of mandrel 28 in piping 16 thereby providing a further flushing action via ports 55 in mandrel 28 proximate a downhole (distal) end of tool 10.

Accordingly and advantageously, should tool 10 become lodged or "sanded-in" in a wellbore, by flowing a ball 33 downhole tool 10 may then be configured to the emergency release position by fluid being supplied to tool 10 at a second pressure which, due to the ball, need not be necessarily higher, and could even conceivably be lower, than typical tool actuation pressures, but nevertheless be able to configure tool 10 to then permit fluid to be supplied via radial port 36 to a precise region in front of (i.e. immediately uphole of tool 10) and along tool 10 within piping 16 where sand build-up and lodging conditions are typically created.

In a further aspect of the invention, a system is disclosed using tool 10 in combination with ported piping 16 and sliding sleeves 14 that are particularly suited to take advantage of the features of tool 10, and in particular allow, once tool 10 is positioned in the actuated position, to effectively open a plurality (i.e. a "cluster") of juxtaposed valves along a piping and thus simultaneously frack the formation 1 in the region of such ports without having to, at each sliding sleeve 12 and associated port 14 at a location desired to be fracked, de-actuate tool 10 so as to withdraw the protuberances 15 to as to be able to pull tool 10 further uphole, and later again have to again re-actuate tool 10 to open the next uphole sleeve 12.

Accordingly, in a first broad aspect of such system featuring the tool 10 in one or more of the embodiments described above and with reference to drawings best showing the system, namely FIGS. 6-9, 13 & 15B, piping 16 may further be provided particularly suited for use of tool 10 of the present invention, where such piping 16 has a plurality of slidable sleeves 12 that are positioned along piping 16 and cover a respective corresponding plurality of ports 14. Notably each of the slidable sleeves 12 are, at an uphole end thereof, coupled to or integrally formed with, at least one radially-outwardly biased finger members 60 axially extending from an uphole side of each sliding sleeve. Each sliding sleeve 12 is thus releasably retained axially within piping 16 by engagement of outwardly protruding tabs 61 on distal ends of the a radially outwardly-biased tabbed finger members 60 engaging a first annular recessed groove 105' on an interior periphery of piping 16.

Advantageously, when tool 10 is configured in the "actuated" state and the protuberances 15 on tool 10 engage a desired sliding sleeve 14 in a region of the tabbed radially-outwardly biased finger members 60 and more particularly in a region of the sleeve 12 bounded by the radially inwardly and outwardly protruding tab 61 of finger members 60 on one (uphole) side thereof and an uphole side of the sliding sleeve 14 on the other, and tool 10 is pulled uphole thereby disengaging the tabs 61 with the annular groove 105' and moving the sleeve and finger members uphole to a position uncovering the desired port 14, tabbed finger members 60 and specifically the outwardly protruding portion of tab 61 thereof then engages a second deeper recessed annular groove 105" more uphole in piping 16. Thus, as best seen comparing FIG. 8 and FIG. 9 when engaged sleeve 14 had been moved uphole from a closed position (FIG. 8) to an opened position (FIG. 9), the second deeper annular groove 105" when so engaged by tabs 61 then permits tool 10 with protuberances 15 still in a radially extended state to continue to be moved uphole for further opening of additional uphole sleeves 12 without having to take the further time-consuming step of needing to stop upward movement of tool 10, de-actuate tool 10 to allow disengagement with the then-opened slidable sleeve 12, before being able to move tool 10 further uphole to actuate the next uphole sleeve 12.

Accordingly, and thus advantageously, such modified sleeve design having radially outwardly biased finger members 60 combined with outward tabs 61 and a deeper annular groove 105", together allow a continuous upward motion to the tool from downhole to uphole and the ability to open a group ("cluster") of sleeves/valves in a single continuous motion, thereby saving time in fracking operations.

In another refinement, tool 10 may further be provided with at least one radial port 36 in mandrel 28 proximate an uphole end 31 thereof.

Tool 10, when provided with such feature, is further configured, such as by the provision of a plug seat 32 on an uphole side of piston member 34, upon application of fluid pressure to the mandrel, to thereby cause piston member 34 shear the shear pins 52 thereby releasing shear mandrel 51 and thus releasing the fixed securement of one end of spring member 40, to thereby allow piston member 34 to be further moved downhole to a third axially most-downhole position (emergency release/flushing configuration) where piston member 34 uncovers, or at least partly uncovers, the at least one radial port 36 in mandrel 28 so as to permit fluid under pressure to pass from within longitudinal bore 57 of mandrel 28 to an exterior of said mandrel.

Optionally, and in addition, where elongate camming member 53 has been further moved downhole to a position, cams 44 thereon contacting camming surface 43 on collets 26 forces protuberances 15 on collets 26 to return to the radially-retracted run-in position and within the outer periphery of mandrel 28, to further aid in withdrawing tool 10 from within a wellbore.

Thus radial port 36, when tool 10 is configured in the "emergency release" position, allows flow of fluid from within the longitudinal bore 57 of mandrel 28 to an exterior of mandrel 28 for purposes of flushing sand and detritus from an immediate uphole region of tool 10.

For a complete definition of the invention and its intended scope, reference is to be made to the summary of the invention and the appended claims read together with and considered with the disclosure and drawings herein.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

I claim:

1. A sleeve-actuating tool for use in selectively opening one or more sleeves that are respectively covering a corresponding number of ports situated along piping within a wellbore, the tool adapted to be coupled to a distal end of continuous tubing and conveyed downhole in a wellbore via the continuous tubing, the tool comprising:

an elongate hollow mandrel, having a longitudinal bore and coupleable at an uphole end thereof to a distal end of continuous tubing and adapted to be in fluid communication with the continuous tubing;

an elongate piston member, having a longitudinal bore and itself situated in the longitudinal bore of the mandrel proximate an uphole end thereof and axially slidable within the longitudinal bore of the mandrel;

a plurality of longitudinally-extending, circumferentially-spaced resiliently flexible collets, each having a camming surface on an elongate interior surface thereof and each having a radially-outwardly extending protuberance on an outer periphery thereof which, when actuated, resiliently extends radially outwardly from an outer periphery of the mandrel;

an elongate camming member, having a longitudinal bore and one or more cams on an exterior periphery thereof adapted for physical contact with said camming surface on the elongate interior surface on each of the collets, the camming member coupled to the piston member and axially slidable within said longitudinal bore of the mandrel;

a spring member, biasing the elongate camming member and the piston member in an uphole direction along the longitudinal bore of the mandrel to a first axial position within the tool such that the elongate camming member and the cams thereon allow the protuberances on the collets to each thereby be positioned in a radially-retracted position within an outer periphery of said mandrel;

at least one radial port in said mandrel proximate an uphole end of thereof which is adapted to permit, when opened, flow of pressurized fluid from within the longitudinal bore of the mandrel to an exterior of the mandrel;

wherein the piston member is slidably moveable within the mandrel from:

(i) a first most-uphole position where the protuberances are caused to be radially retracted and the tool is in a run-in position; to (ii) a second intermediate position more downhole than the first most-uphole position, namely wherein the piston member nevertheless still covers each of said at least one radial ports and wherein the protuberances are in a radially-outwardly extended position and the tool is thus configured to be in an actuated position; to (iii) a third axially most-downhole position, wherein the piston member has uncovered or at least partly uncovered the at least one radial port in the mandrel so as to permit fluid under pressure to pass from within the longitudinal bore of the mandrel to an exterior of the mandrel;

and wherein upon fluid under a first pressure being provided in said continuous tubing to an uphole end of the tool, the piston member of the tool is forced downhole and is adapted, when forced downhole, to: (a) force the elongate camming member to a second axial position more downhole than the first axial position thereby compressing or further compressing said spring member; and (b) cause the cams thereon to likewise move longitudinally downhole and engage the camming surface on each of the longitudinally-extending collets thereby causing the protuberances thereon to extend radially outwardly past the outer periphery of the mandrel.

2. The sleeve-actuating tool as claimed in claim 1, wherein the one or more cams comprise at least one wedge member and are adapted to contact corresponding one or more correspondingly-configured wedge members on said camming surface on each of said collets.

3. The sleeve-actuating tool as claimed in claim 1, wherein the longitudinal bore of the piston member and the longitudinal bore of the camming member are co-axial and longitudinally aligned such that fluid may pass therethrough.

4. The sleeve-actuating tool as claimed in claim 1, wherein the piston member further comprises a plug seat at a most-uphole end thereof, the plug seat adapted to receive therein a plug member flowed downhole in said continuous tubing, wherein the plug seat when the plug member is seated therein prevents flow of pressurized fluid through the piston member and causes the piston member to move to the third most-downhole position.

5. The sleeve-actuating tool as claimed in claim 4, further comprising:

a frangible release member releasably securing the spring member at one end thereof;

wherein upon the plug member being flowed downhole in said continuous tubing and onto the plug seat and fluid under a second pressure being provided to the tool via the continuous tubing, the piston member is configured so as to be forced downhole so as to cause said frangible release member to shear, so as to:

(i) release said one end of the spring member from releasable securement; and (ii) thereby permit the piston member and elongate camming member to move downhole or further downhole in the tool to the third axially most-downhole position.

6. The sleeve-actuating tool as claimed in claim 4, further comprising:

a frangible release member releasably securing one end of the spring member in a fixed axial position within the longitudinal bore of the mandrel; and wherein the piston member when forced downhole to the third axially most-downhole position causes to the frangible release member to be sheared thereby releasing said one end of the spring member from releasable securement and thereby permitting the piston member and elongate camming member to move further downhole so as to:

(i) cause the cams on the elongate camming member to permit the protuberances on the collets to return to a radially-retracted position within the outer periphery of the mandrel; and (ii) uncover, or uncover some of, the at least one radial ports, so as to permit fluid under pressure to pass from within the longitudinal bore of the mandrel to an exterior of the mandrel.

7. A system for slidably opening sleeves that are covering ports situated along a wellbore, comprising:

(I) a tool, said tool comprising:

an elongate, hollow mandrel having an outer periphery and having a longitudinal bore, configured so as to be coupleable at an uphole end thereof to a distal end of a continuous tubing and be in fluid communication with the continuous tubing;

an elongate piston member, having a longitudinal bore and which is itself situated in said longitudinal bore of the hollow mandrel proximate an uphole end thereof, said piston member axially slidable within the longitudinal bore of the mandrel;

a plurality of longitudinally-extending, circumferentially-spaced collets, each having a camming surface on an elongate interior surface thereof and each having a radially-outwardly extending protuberance on an outer periphery thereof which protuberance, when actuated, resiliently extends radially outwardly;

an elongate camming member having a longitudinal bore and one or more cams on an exterior periphery thereof adapted for physical contact with said camming surface on the elongate interior surface on each of the collets, the elongate camming member coupled to the piston member and axially slidable within said longitudinal bore of the mandrel;

a spring member, biasing the elongate camming member and the piston member in an uphole direction along the longitudinal bore of the mandrel such that the cams on the elongate camming member cause the protuberances on the collets to each be in a radially-retracted position;

wherein the piston member is slidably moveable within the mandrel, upon application of fluid pressure on an uphole side thereof, from:

(i) a first most-uphole position where the protuberances are caused to be in the radially retracted position and the tool is in a run-in position; to (ii) a second position more downhole than the first most-uphole position, namely a position wherein the protuberances are caused by the piston member to be in a radially-outwardly extended position when the tool is thusly configured to be in an actuated state;

(II) piping within the wellbore having a plurality of slidable sleeves that are positioned along the piping and cover a respective corresponding plurality of ports situated along the piping;

(i) each of the slidable sleeves being releasably retained in a downhole position within the piping and covering a respective of the plurality of ports by engagement of one or more radially outwardly-biased tabbed finger members on the slidable sleeves with a respective first annular groove situated on an interior periphery of said piping;

wherein when the tool is caused to be configured in the actuated state and the protuberances on the tool engage the tabbed finger members on one of the plurality of slidable sleeves and the tool is moved uphole, the tabbed finger members are caused to disengage the first annular groove and both they and the one sliding sleeve are adapted to together be moved uphole to an uphole position uncovering the respective port in said piping, where the tabbed finger members thereof then engage a second deeper recessed annular groove more uphole in said piping which second deeper annular groove when engaged by the tabbed finger members permits the tabbed finger members to become disengaged with the protuberances on the tool and thereby allow the tool to be further pulled uphole without retraction of the protuberances.

8. The system for slidably opening sleeves as claimed in claim 7, wherein the tool of said system further comprises:

at least one radial port in the mandrel proximate an uphole end of thereof which is adapted to permit, when opened, flow of fluid from within the longitudinal bore of the mandrel to an exterior of the mandrel; and the tool is further configured so as to permit, upon a plug member being flowed down the continuous piping to the tool, the piston member thereof to be further moved downhole to a third axially most-downhole position where the piston member uncovers, or at least partly uncovers, the at least one radial port in said mandrel so as to permit fluid under pressure to pass from within said longitudinal bore of the mandrel to an exterior of said mandrel and where said elongate camming member has been further moved downhole to a position whereby cams thereon permit the protuberances on the collets to return to the radially-retracted run-in position within the outer periphery of the mandrel.

9. A method for slidably opening sleeves that are respectively covering a corresponding plurality of ports longitudinally spaced and situated along piping in a wellbore, comprising the steps of:

affixing a tool to a distal end of continuous tubing such that the tool is in fluid communication therewith;

running the continuous tubing and tool downhole through the piping and a plurality of interior slidable sleeves within such piping respectively covering the corresponding plurality of ports, so as to position the tool proximate a distal end of the wellbore;

applying a first fluid pressure within said continuous tubing and causing a piston member and elongate camming member coupled together in said tool to be together moved axially downhole in said tool so as to cause cams on said elongate camming member to contact an interior camming surface on each of a plurality of collets, so as to cause radial outward extension of protuberances on each of said collets past an outer periphery of the tool;

pulling upwardly on the continuous tubing and affixed tool so as to cause the radially-extended protuberances on the tool to engage the at least one sliding sleeve in the region of outwardly-biased tabbed finger members thereon and sliding the at least one sliding sleeve uphole so as to thereby uncover and thereby open the respective one of the at least one ports along the piping;

retaining the sliding sleeve in such opened position by each outwardly-biased tabbed finger members on the sliding sleeve then becoming releasably engaged with an annular interior groove in the piping, thereby simultaneously releasing the protuberances on the collets from engagement with said tabbed finger members on the sliding sleeves and permitting the tool to be further pulled uphole without radial retraction of the protuberances on the collets.

10. The method for slidably opening sleeves as claimed in claim 9, wherein in the event the tool and/or continuous tubing becomes lodged in said piping where further uphole movement of the tool is prevented or for any other reason, flowing a plug member down the continuous tubing and into the bore of the tool thereby obstructing the longitudinal bore of the piston member and preventing fluid under pressure flowing through piston member of the tool and thusly applying fluid pressure to an uphole end of the piston so as to cause further downhole displacement of the piston member so as to:

(i) uncover a radial port within said tool to thereby cause fluid under pressure within the longitudinal bore of the tool to then travel to an exterior of the tool via said radial port and into an annular region between the tool and the piping so as to thereby potentially dislodge the tool and continuous tubing from within said piping.

11. The method for slidably opening sleeves as claimed in claim 10, such method further comprising, at the time of carrying out step (i) above:

(ii) causing the elongate camming member and the cams thereon to further interact with the interior camming surface on each of the collets in a manner that allows radial inward retraction of the protrusions on the tool to an extent that the protrusions no longer extend radially outwardly from the exterior of the tool.

12. A piping sub assembly for use in wellbores, such piping sub assembly comprising:

(i) a hollow elongate mandrel having a hollow bore and an uphole side and a downhole side;

(ii) a series of ports, each situated at a specific axial distance along the mandrel circumferentially spaced about a periphery of the mandrel;

(iii) a slidable annular hollow sleeve, slidably moveable from a first closed position covering the series of ports to a second open position in which the series of ports are uncovered;

(iv) an associated plurality of finger members each having a tab at a distal end thereof which is radially outwardly biased, each of the tabs having a radially inwardly extending portion and a radially outwardly extending portion, wherein the plurality of finger members are coupled to or integrally formed with an uphole side edge of the sliding sleeve, with the finger members and the tabs together configured to receive a protuberance from an actuating tool so as to permit the sliding sleeve to be moved by a protruding protuberance on the tool from the first open position to the second closed position;

(v) a first annular groove in an interior surface of the hollow mandrel, adapted to receive the radially outwardly extending portion of each tab when the sliding sleeve is in said first closed position so as to releasably retain the sliding sleeve in the first closed position;

(vi) a second annular groove in an interior surface of the hollow mandrel of greater radial depth than the first annular groove, adapted to receive the radially outwardly extending portion of each tab therein when the sliding sleeve is in said second open position so as to releasably retain the sliding sleeve in the second open position when a tool and protuberance thereon moves the sliding sleeve to the second position;

wherein when said sliding sleeve is moved towards the uphole side of the mandrel by the tool from the first closed position to the second open position, the radially outwardly extending portion of the tab on each of the finger members is adapted to enter the second annular groove and be positioned therein to such a depth that the inwardly extending portion of each tab releases from engagement the protuberance on said tool, and the tool is then thereafter free to travel further uphole in the mandrel and the sliding sleeve remains retained in the second open position.

* * * * *